US012709895B1

(12) United States Patent
Smith, Jr.

(10) Patent No.: US 12,709,895 B1
(45) Date of Patent: Aug. 18, 2026

(54) HYBRID STANDING SEAM METAL PANEL AND MEMBRANE ROOF COVER SYSTEM

(71) Applicant: McElroy Metal Mill, Inc., Bossier City, LA (US)

(72) Inventor: Charles L. Smith, Jr., Round Top, TX (US)

(73) Assignee: McElroy Metal Mill, Inc., Bossier City, LA (US)

( * ) Notice: Subject to any disclaimer, the term of this patent is extended or adjusted under 35 U.S.C. 154(b) by 259 days.

(21) Appl. No.: 18/658,476

(22) Filed: May 8, 2024

(51) Int. Cl.
*E04D 3/369* (2006.01)
*E04D 3/30* (2006.01)
*E04D 3/36* (2006.01)
*E04D 3/367* (2006.01)

(52) U.S. Cl.
CPC ..... *E04D 3/369* (2013.01); *E04D 3/30* (2013.01); *E04D 3/3607* (2013.01); *E04D 3/364* (2013.01)

(58) Field of Classification Search
CPC ..... E04D 3/30; E04D 3/3607; E04D 3/364; E04D 3/369
USPC ..... 52/506.01
See application file for complete search history.

(56) References Cited

U.S. PATENT DOCUMENTS 3,603,056 A * 9/1971 Roth ..... E04D 1/365 52/468
3,606,720 A * 9/1971 Roth et al. ..... E04D 3/3607 52/489.1
4,089,145 A * 5/1978 DeVries, Jr. ..... E04D 3/30 52/630
4,099,356 A * 7/1978 Graham ..... E04D 3/40 52/276
4,213,282 A * 7/1980 Heckelsberg ..... E04D 3/362 52/410
4,217,741 A * 8/1980 Cole ..... E04D 3/364 52/537
4,269,012 A * 5/1981 Mattingly ..... E04D 3/38 52/394
4,437,283 A * 3/1984 Benoit ..... E04D 5/146 52/96
4,476,658 A * 10/1984 Johnstone ..... E04D 3/366 52/404.1
4,497,151 A * 2/1985 Simpson ..... E04D 3/363 52/543

(Continued)

OTHER PUBLICATIONS

McElroy Metal, Inc., *Trap-Tee* (Oct. 2023).
McElroy Metal, Inc., *Trap-Tee Product Information* (Dec. 2023).

*Primary Examiner* — James M Ference
(74) *Attorney, Agent, or Firm* — Keith B. Willhelm

(57) ABSTRACT

Hybrid roof cover systems comprise a metal panel field and a membrane field joined by metal standing seam transition roof panels. The metal transition panel comprises an upstanding side, a planar portion, and a polymer layer. The upstanding side defines a first lateral edge of the metal transition panel. The first lateral edge is symmetrical with a lateral edge of an adjacent roof panel in the metal panel field. The first lateral edge is adapted to form a sidelap between the metal transition panel and the adjacent roof panel in the metal panel field. The planar portion extends from the first lateral edge to a second lateral edge of the metal transition panel. The polymer layer is bonded to an upper face of the planar portion of the metal transition panel and is adapted to bond to the membrane sheet in the membrane field of the hybrid roof cover system.

36 Claims, 12 Drawing Sheets

(56) References Cited

U.S. PATENT DOCUMENTS 4,575,983 A * 3/1986 Lott, Jr. ..... E04D 3/363 52/713
4,649,684 A * 3/1987 Petree ..... E04D 3/366 52/395
4,700,522 A * 10/1987 Simpson ..... E04D 3/363 52/545
4,741,142 A * 5/1988 Otto ..... E04D 3/365 52/529
4,870,798 A * 10/1989 Richter ..... E04D 3/364 52/537
4,987,716 A * 1/1991 Boyd ..... E04D 3/364 52/537
5,287,670 A * 2/1994 Funaki ..... E04D 3/3608 52/520
5,367,848 A * 11/1994 McConnohie ..... E04D 3/3608 52/336
5,423,157 A * 6/1995 Watanabe ..... E04D 3/366 52/468
5,572,843 A * 11/1996 Jordan ..... E04D 5/142 52/410
5,596,858 A * 1/1997 Jordan ..... E04D 3/366 52/717.03
5,685,118 A * 11/1997 Simpson ..... E04C 3/08 52/537
5,692,352 A * 12/1997 Simpson ..... E04D 3/3602 52/537
5,697,197 A * 12/1997 Simpson ..... E04D 3/38 52/537
5,704,170 A * 1/1998 Simpson ..... E04D 3/363 52/645
5,737,892 A * 4/1998 Greenberg ..... E04D 3/362 52/549
5,737,894 A * 4/1998 Simpson ..... E04D 15/04 52/573.1
5,911,663 A * 6/1999 Eidson ..... E04D 13/165 52/537
6,301,853 B1 * 10/2001 Simpson ..... E04D 3/362 52/550
6,354,045 B1 * 3/2002 Boone ..... E04D 3/3608 52/95
6,889,478 B1 * 5/2005 Simpson ..... E04D 3/3602 52/545
7,963,083 B1 * 6/2011 Briggs ..... E04D 3/364 52/489.1
8,322,113 B2 * 12/2012 Shapiro ..... E04D 5/146 52/410
8,341,917 B2 * 1/2013 Resso ..... F24S 10/75 52/302.1
8,713,864 B1 * 5/2014 Smith, Jr. ..... E04D 3/364 52/203
8,713,865 B2 * 5/2014 Hall ..... E04H 9/10 52/203
8,887,464 B1 * 11/2014 Smith, Jr. ..... E04D 3/366 52/395
8,938,924 B1 * 1/2015 Smith, Jr. ..... E04D 3/362 52/395
9,404,262 B1 * 8/2016 Smith, Jr. ..... E04D 3/3608
11,639,604 B1 * 5/2023 Smith, Jr. ..... E04D 3/30 52/90.1
2005/0055903 A1 * 3/2005 Greenberg ..... E04D 3/362 52/198
2008/0250742 A1 * 10/2008 Smola ..... E04D 3/362 52/543
2010/0275525 A1 * 11/2010 Wendelburg ..... E04D 13/1681 52/90.2
2010/0307085 A1 * 12/2010 Resso ..... E04D 1/34 52/302.1
2013/0009025 A1 * 1/2013 Stearns ..... G09F 7/18 248/237
2015/0040502 A1 * 2/2015 Jaks ..... E04D 3/362 52/309.4

* cited by examiner

HYBRID STANDING SEAM METAL PANEL AND MEMBRANE ROOF COVER SYSTEM

FIELD OF THE INVENTION

The present invention relates to hybrid roof covers comprising a metal panel field and a membrane field, and more particularly, to a metal standing seam transition roof panel that provides a transition between a hybrid roof having a metal panel field and a membrane field.

BACKGROUND OF THE INVENTION

There are a wide variety of metal covers that have been used in the construction industry to provide a building's outermost barrier to wind and water. They may be manufactured to resemble wood shake, slate, shingles, clay tiles or other non-metallic cover materials and may be installed on exterior walls or on roofs. More typically, however, metal roof covers utilize rather elongated metal panels installed along the slope of a roof.

Metal panel roofs utilize various flashings and other components where the fields of a roof terminate or intersect, such as the eaves, gables, valleys, ridges, and hips of a roof. Even in roofs having many different intersecting or overlapping fields, however, the basic construction of metal panel roofs across the expanse of a roof is fairly standard. Most commonly, an array of spaced, elongated support members or "purlins" is mounted across the structural rafters of a roof substructure. The purlins run horizontally across the rafters, i.e., across the slope of the roof. Layers of insulation and various barriers may be, and for climate-controlled buildings usually are installed as well. Decking also may be provided instead of or in addition to purlins for additional support. A cover is provided by a series of rather elongated, mostly flat, interconnected metal panels.

Each cover panel is typically about a foot to three feet in width. Though they may be cut to any length, they commonly are 30 to 40 feet long and may run as long as 200 feet. Preferably, they run the length of the slope over which they are installed. The lateral edges of the panels are bent in various configurations to form upwardly extending sides and a trough in the middle. The trough is where most of the water will be shed from the roof. Adjacent panels are joined along their upwardly extending sides to create relatively narrow seams which are elevated above the trough.

The panels are laid out such that the seams run vertically, i.e., with the slope of the roof. The panels also may have one or more vertical ridges running through the trough, and it is those vertical seams and ridges that create the distinctive appearance that consumers associate with metal roofs. More importantly, however, since the seams between adjacent panels are formed a few inches above the troughs where most rain will be shed, metal panel roofs can be very resistant to leaking.

Raised-seam, metal panels may be classified according to the way they are installed. So called "through panel" or "exposed" fastener panels are installed with screws or other fasteners that penetrate through the cover panels. The panels typically are laid over a roof so that their sides overlap and form a raised, often trapezoidal shaped seam or "lap" rib. The panels then are joined together along the lap rib by, e.g., gasketed screws. Gasketed screws also are driven through the trough. Leakage around the fastener, at least initially, is not a significant problem. Over time, however, the elastomeric material from which the screw gaskets are fabricated can deteriorate, and leaks tend to develop around penetrating fasteners.

"Standing seam" covers can provide better resistance to leakage over longer periods of time and, in the eyes of many beholders, provide a more beautiful roof. In a standing seam cover, the metal panels are secured with concealed connectors or "clips" instead of unsightly and leak-prone penetrating fasteners. Most commonly, a plurality of relatively small panel clips is installed in a fairly widely spaced, array running vertically in what will become a seam line between adjacent panels. Panels then are installed between the vertical lines of clips, with the upturned seam edges of the panels abutting and mating with the clips and each other. There are no penetrations through the panels when clips are used. Moreover, all gaps between the panels and the clips are elevated well above the trough through which most water runoff occurs. Thus, standing seam panel covers provide better, longer resistance to leakage as compared to covers using screws or other "exposed" fasteners that penetrate the panels.

There are many conventional systems that use non-penetrating clips with standing seam metal panels. In new installations, the clips often are mounted to an array of spaced, elongated support members or "purlins" which are mounted across the structural rafters of a roof substructure. The purlins run horizontally across the rafters, i.e., across the slope of the roof. In other roofs, the clips may be mounted to decking installed on the roof substructure.

Such systems are disclosed in U.S. Pat. No. 4,575,983 to H. Lott, Jr. et al. Panel clips are mounted to purlins, and the metal panels are secured to the clips. The panels disclosed therein are asymmetrical standing seam panels. Asymmetrical panels have mating male-female connections, each panel having a male connection formed in one side and a female connection formed in its other side. Thus, installation must proceed in a certain direction across the roof, and removal for repair must proceed in the opposite direction.

Symmetrical standing seam panels, however, have sides that are mirror images of each other and are joined with a separate seam cover. Symmetrical panels, therefore, may be installed in either direction. A damaged panel also may be removed for replacement without removing any adjacent panels. Examples of symmetrical standing seam roof covers where non-penetrating individual clips are mounted to purlins are disclosed in U.S. Pat. No. 4,649,684 to L. Petree et al. Other covers, such as those disclosed in U.S. Pat. No. 6,354,045 to M Boone et al., U.S. Pat. No. 5,737,892 to P. Greenberg, and U.S. Pat. No. 11,639,604 to C. Smith, Jr., utilize individual and elongated, "continuous" clips that are mounted to and span adjacent purlins. Symmetrical standing seam recover systems, such as those disclosed in U.S. Pat. No. 8,886,464 to C. Smith, Jr., also use individual and continuous clips. The continuous clips are used primarily in edge and corner zones to provide greater resistance to uplift forces created by wind blowing over the surface of the roof. While they may be more expensive than covers using asymmetrical panels, such symmetrical panel covers can offer improved leak protection, better uplift resistance, and longer service life.

Other widely installed types of roof covers include so-called membrane covers. Membrane covers incorporate large sheets of water impermeable membranes that are installed over a cover or support board. The edges of the sheets are seamed together to provide a continuous, watertight roof covering. Because they are watertight, membrane covers may be used on "flat" roofs, that is, roofs with a minimal pitch such as from about ¼ to ½ inch per foot. Flat roofs, because of their minimal pitch and because the subroof may be uneven, may not necessarily shed water very quickly. Largely for aesthetic reasons, membrane covers are used primarily on such "flat" roofs, although they sometimes are used on low-pitched roofs.

Many different membranes have been used as roof covers, but the most common membranes include modified bitumen systems, thermoset membranes, and thermoplastic membranes. Modified bitumen membranes consist of fabric-reinforced sheets of a bitumen-polymer mix, such as styrene-butadiene-styrene (SBS) and atactic polypropylene (APP) polymers. Different polymers are used to enhance various properties of bitumen, such as strength, flexibility, or heat resistance. SBS and APP polymers, for example, increase the flexibility of a bitumen sheet. Modified bitumen systems are relatively inexpensive, but typically require two or even three layers of membranes to provide a watertight cover. Seaming the ends of sheets together also can be more involved. Typically, seaming requires "hot-mopping" asphalt over the seams or torching the underside of the sheet.

Unlike modified bitumen membranes, a single layer of thermoset and thermoplastic membranes can be used to provide a single ply roof. Cured ethylene propylene diene monomer (EPDM) membranes are the most common thermoset membranes. They often are referred to as "rubber" roofs and typically incorporate carbon black to protect against degradation from ultraviolet light cast by the sun. They may be fabric reinforced or non-reinforced. The sheets may be installed over a support board by fully adhering them or connecting them with mechanical fasteners. Sheets typically are seamed with either liquid adhesives or special tapes.

Common thermoplastic membranes include polyvinyl chloride (PVC), thermoplastic olefin (TPO), and ketone ethylene ester (KEE) membranes. Thermoplastic membranes become soft when heated and harden and bind as the membrane cools. Thus, seams in thermoplastic membranes most commonly are formed by heat-welding the ends together, although welded seams also may be formed with solvents. The resulting welds are generally at least as strong as the original membrane and typically are stronger than chemical bonds formed with thermoset sheets.

Metal panel roofs are more enduring, however, than even the best membrane roofs. A properly installed metal panel roof may have a service life of from 40 to 70 years. Membrane roofs on the other hand, have significantly shorter service lives, generally from about 25 to 30 years. On the other hand, very few roofs are featureless. That is, most roofs have a variety of projections extending through the roof cover, such as skylights, chimneys, and vents. It is easier to provide a weathertight cover over the featureless portions of a roof, than it is to provide a weathertight seal around projections extending through the cover. Polymer coatings have been applied to metal panels in an effort to provide better seals around projections, but in such cases the projections still extend through a metal panel. Trimming and sealing remain problematic. In that respect, thermoset membrane, and especially thermoplastic membrane roofs have a distinct advantage over metal panel roofs. The membrane is much more flexible, and more easily and closely trimmed to fit around projections. Sealants and tapes also tend to bond more effectively to the membrane than to metal surfaces.

Thus, metal panel roof covers and membrane covers offer different and distinct advantages over the other. They are, however, rarely, if ever, used in combination. Transition areas in roof covers are always problematic, especially between dissimilar materials. As yet there are no satisfactory systems for combining metal panel covers and membrane covers into a hybrid roof cover to provide a continuous, enduring, and reliable is weather tight cover, especially around projections through the roof.

The statements in this section are intended to provide background information related to the invention disclosed and claimed herein. Such information may or may not constitute prior art. It will be appreciated from the foregoing, however, that there remains a need for new and improved hybrid roof covers comprising a metal panel field and a membrane field. Such disadvantages and others inherent in the prior art are addressed by various aspects and embodiments of the subject invention.

SUMMARY OF THE INVENTION

The subject invention, in its various aspects and embodiments, is directed generally to hybrid roof covers having a metal panel field and a membrane field. A metal standing seam transition roof panel provides a transition between the metal panel field and the membrane field. One aspect and embodiment of the invention provides for a metal standing seam transition roof panel for a hybrid roof cover system. The hybrid roof cover system comprises a metal panel field and a membrane field. The metal panel field comprises a plurality of metal standing seam roof panels interconnected by sidelaps along their lateral edges. The membrane field comprises a membrane sheet. The metal transition panel is adapted to provide a transition between the metal panel field and the membrane field and comprises an upstanding side, a planar portion, and a polymer layer. The upstanding side defines a first lateral edge of the metal transition panel. The first lateral edge is symmetrical with a lateral edge of a roof panel in the metal panel field of the hybrid roof cover system that is adjacent to the metal transition panel. The first lateral edge is adapted to form a sidelap between the metal transition panel and the adjacent roof panel in the metal panel field of the hybrid roof cover system. The planar portion extends from the first lateral edge to a second lateral edge of the metal transition panel. The polymer layer is bonded to an upper face of the planar portion of the metal transition panel and is adapted to bond to the membrane sheet in the membrane field of the hybrid roof cover system.

Other embodiments provide such metal transition panels where the polymer layer is bonded to substantially the entire upper face of the planar portion of the metal transition panel.

Yet embodiments provide such metal transition panels where the polymer layer is bonded to substantially the entire area of an upper face of the metal transition panel.

Still other embodiments provide such metal transition panels where the polymer layer of the metal transition panel is composed of a thermoplastic polymer.

Additional embodiments provide such metal transition panels where the polymer layer of the metal transition panel is selected from the group consisting of polyvinyl chloride (PVC), thermoplastic polyolefin (TPO), and ketone ethylene ester (KEE).

Further embodiments provide such metal transition panels where the polymer layer of the metal transition panel is composed of a thermoset polymer.

Other embodiments provide such metal transition panels where the thermoset polymer is ethylene propylene diene monomer (EPDM).

Yet other embodiments provide such metal transition panels where the polymer layer is bonded to the planar portion of the metal transition panel by heat bonding.

Still other embodiments provide such metal transition panels where the polymer layer is from about 25 to about 35 mm thick.

Additional embodiments provide such metal transition panels where the first lateral edge of the metal transition panel comprise an angled portion, a vertical portion, and first and second horizontal portions. The angled portion extends upward and outward from the planar portion. The vertical portion extends upward from the angled portion and generally perpendicular to the planar portion. The first horizontal portion extends inward from the vertical portion and generally parallel to the planar portion. The second horizontal portion extends above, outward from, and generally parallel to the first horizontal portion. The lateral edge is formed by bends in the metal transition panel defining the portions of the lateral edge. The sidelap between the metal transition panel and the adjacent roof panel in the metal panel field is formed on panel clips of the metal panel field of the hybrid roof cover system.

Further embodiments provide such metal transition panels where the lateral edge angled portion extends from the planar portion at an angle of from about 300 to about 60°.

Other embodiments provide such metal transition panels where the lateral edge angled portion extends from the trough at an angle of about 45°.

Yet other embodiments provide such metal transition panels where the first and second lateral edge horizontal portions are doubled over to form a U-shaped channel adapted to receive a support portion of the panel clips of the metal panel field of the hybrid roof cover system.

In other aspects and embodiments, the subject invention provides methods of installing a hybrid roof cover system to accommodate projections through a roof. The method comprises providing a metal panel field in a portion of the roof where the projections are not present. The metal panel filed is provided by installing a plurality of metal standing seam roof panels by forming, on an array of panel clips, sidelaps along lateral edges of the metal standing seam roof panels. The method further comprises installing the novel metal transition panel to a metal standing seam roof panel in the metal panel field by forming, on the panel clips, a transition panel sidelap between the metal transition panel and the metal standing seam roof panel. A membrane field is provided in a portion of the roof with the projections by bonding a membrane to the polymer layer of the metal transition panel. The membrane is sealed around the projections.

In still other aspects and embodiments, the subject invention provides hybrid roof cover systems. The hybrid roof cover system comprises a metal panel field, a membrane filed, a projection, and a metal standing seam transition roof panel. The metal panel filed comprises a plurality of panel clips and a metal panel cover. The panel clips are attached to a support and arranged in linear arrays running along a pitch of the hybrid roof cover system. The metal panel cover is attached to the panel clips and comprises a plurality of metal standing seam roof panels. The metal standing seam roof panels have upstanding symmetrical sides defining lateral edges and are interconnected along adjacent lateral edges by sidelaps formed on the panel clips and extending along the pitch of the cover system. The metal standing seam roof panels have a trough extending between the lateral edges. The membrane field comprises a membrane sheet. The projection extends through the membrane field. The metal standing seam transition roof panel provides a transition from the metal panel field to the membrane field and comprises an upstanding side, a planar portion, and a polymer layer. The upstanding side defines a first lateral edge of the metal transition panel that is symmetrical to the sides of the metal roof panels in the metal panel field. The planar portion extends horizontally from the first lateral edge to a second lateral edge of the metal transition panel. The polymer layer is bonded to an upper face of the planar portion of the metal transition panel. The first lateral edge of the metal transition panel is interconnected along the lateral edge of the metal roof panel in the metal panel field that is adjacent to the metal transition panel by a transition panel sidelap formed on the panel clips. The membrane sheet of the membrane field is bonded to the polymer layer of the metal transition panel.

Other embodiments provide such hybrid roof cover systems where the polymer layer is bonded to substantially the entire upper face of the planar portion of the metal transition panel.

Yet other embodiments provide such hybrid roof cover systems where the polymer layer is bonded to substantially the entire area of an upper face of the metal transition panel.

Still other embodiments provide such hybrid roof cover systems where the polymer layer of the metal transition panel is composed of a thermoplastic polymer.

Additional embodiments provide such hybrid roof cover systems where the polymer layer of the metal transition panel is selected from the group consisting of polyvinyl chloride (PVC), thermoplastic polyolefin (TPO), and ketone ethylene ester (KEE).

Further embodiments provide such hybrid roof cover systems where the polymer layer of the metal transition panel is composed of a thermoset polymer.

Other embodiments provide such hybrid roof cover systems where the thermoset polymer is ethylene propylene diene monomer (EPDM).

Yet other embodiments provide such hybrid roof cover systems where the polymer layer is bonded to the planar portion of the metal transition panel by heat bonding.

Still other embodiments provide such hybrid roof cover systems where the polymer layer is from about 25 to about 35 mm thick.

Additional embodiments provide such hybrid roof cover systems where the membrane sheet in the membrane field is composed of a thermoplastic polymer.

Further embodiments provide such hybrid roof cover systems where the thermoplastic polymer is selected from the group consisting of polyvinyl chloride (PVC), thermoplastic polyolefin (TPO), and ketone ethylene ester (KEE).

Other embodiments provide such hybrid roof cover systems where the membrane sheet in the membrane field is composed of a thermoset polymer.

Yet other embodiments provide such hybrid roof cover systems where the thermoset polymer is ethylene propylene diene monomer (EPDM).

Still other embodiments provide such hybrid roof cover systems where the membrane sheet is from about 50 to about 60 mm thick.

Additional embodiments provide such hybrid roof cover systems where the hybrid cover system comprises first and second the metal panel fields and first and second metal transition panels. The membrane field extends between the first and second the metal fields. The first metal transition panel provides a transition from the first metal panel field to the membrane field and the second metal transition panel provides a transition from the second metal panel field to the membrane field.

Further embodiments provide such hybrid roof cover systems where the hybrid cover system comprises an array of spaced purlins providing the support. The purlins run across the pitch of the hybrid cover system and the plurality of panel clips being attached to the purlins.

Other embodiments provide such hybrid roof cover systems where the hybrid cover system comprises a support board attached to the purlins and extending under the planar portion of the metal transition panel and across the membrane field. The membrane sheet of the membrane field is installed over the planar portion of the metal transition panel and the support board.

Yet other embodiments provide such hybrid roof cover systems where the hybrid cover system comprises insulation disposed between the support and the metal panel cover.

Still other embodiments provide such hybrid roof cover systems where the panel clips are continuous panel clips.

Additional embodiments provide such hybrid roof cover systems where the panel clips include individual panel clips installed in a field zone of the metal panel field and continuous panel clips installed in an edge zone or a corner zone of the metal panel field.

In other aspects and embodiments, the subject invention provides hybrid roof recover systems installed over an existing cover of a roof cover system. The hybrid recover system comprises a metal panel recover field, a membrane recover field, a projection, and a metal standing seam transition roof panel. The metal panel recover field comprises a plurality of panel clips and a metal panel recover. The plurality of panel clips are mounted is above the existing cover system and arranged in linear arrays running along a pitch of the hybrid roof recover system. The metal panel recover is attached to the panel clips. The metal panel recover comprises a plurality of metal standing seam roof panels having upstanding symmetrical sides defining lateral edges and a trough extending between the lateral edges. The metal standing seam roof panels are interconnected along adjacent lateral edges by sidelaps formed on the panel clips and extending along the pitch of the cover system. The membrane recover field comprising a membrane sheet. The projection extends through the membrane field. The metal standing seam transition roof panel provides a transition from the metal panel recover field to the membrane recover field and comprises an upstanding side, a planar portion, and a polymer layer. The upstanding side defines a first lateral edge of the metal transition panel that is symmetrical to the sides of the metal roof panels in the metal panel recover field. The planar portion extends horizontally from the first lateral edge to a second lateral edge of the metal transition panel. The polymer layer is bonded to an upper face of the planar portion of the metal transition panel. The first lateral edge of the metal transition panel is interconnected along the lateral edge of the metal roof panel in the metal panel recover field that is adjacent to the metal transition panel by a transition panel sidelap formed on the panel clips. The membrane sheet of the membrane recover field is bonded to the polymer layer of the metal transition panel.

Other embodiments provide such hybrid roof recover systems where the polymer layer is bonded to substantially the entire upper face of the planar portion of the metal transition panel.

Yet other embodiments provide such hybrid roof recover systems where the polymer layer is bonded to substantially the entire area of an upper face of the metal transition panel.

Still other embodiments provide such hybrid roof recover systems where the panel clips are attached to the existing cover system.

Additional embodiments provide such hybrid roof recover systems where the existing cover system comprises a support frame having an array of spaced purlins running across the pitch of the existing cover system. The plurality of panel clips are attached to the purlins.

Further embodiments provide such hybrid roof recover systems where the hybrid recover system comprises a recover support frame having an array of spaced recover purlins attached to the existing cover system and running across the pitch of the hybrid roof recover system. The plurality of panel clips are attached to the recover purlins.

Other embodiments provide such hybrid roof recover systems where the hybrid recover system comprises a support board. The support board is mounted to the recover purlins and extends under the planar portion of the metal transition panel and across the membrane recover field. The membrane sheet of the membrane field extends across the support board.

Yet other embodiments provide such hybrid roof recover systems where the hybrid recover system comprises rigid foam insulation boards disposed between the existing cover system and the metal panel recover.

Still other embodiments provide such hybrid roof recover systems where the hybrid recover system comprises rigid foam insulation boards and a support board. The rigid foam insulation boards are installed over the existing cover system in the membrane recover field. The support board extends under the planar portion of the metal transition panel. The membrane sheet extends across the rigid foam insulation.

Finally, still other aspects and embodiments of the invention will provide such metal transition panels, hybrid cover systems, and hybrid recover systems, and methods having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
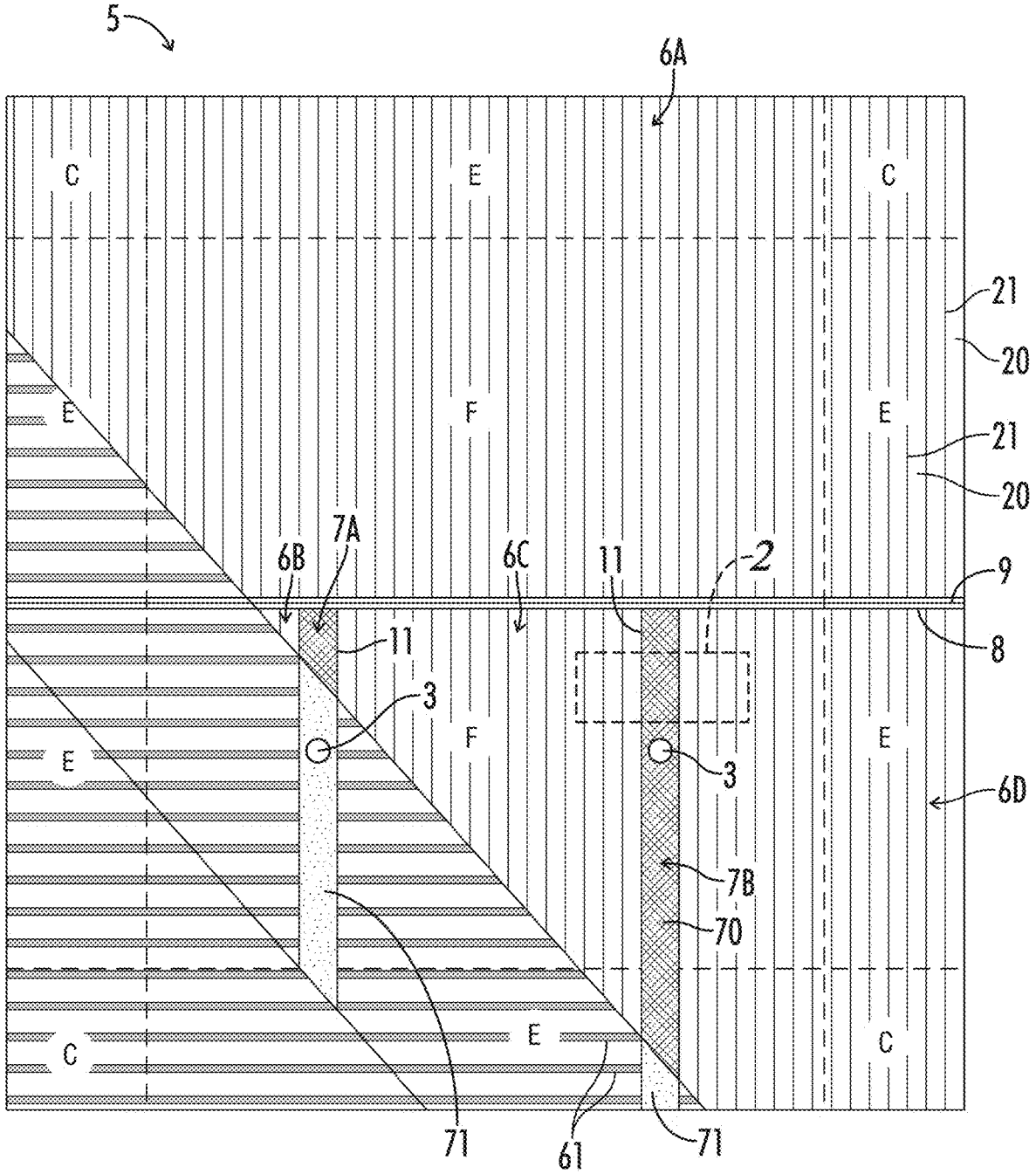
FIG. 1 is a plan view, having partial tear-away views, showing somewhat schematically a first preferred embodiment 5 of the novel hybrid roof covers of the subject invention showing a metal panel field 6 and a membrane field 7.
Figure 2:
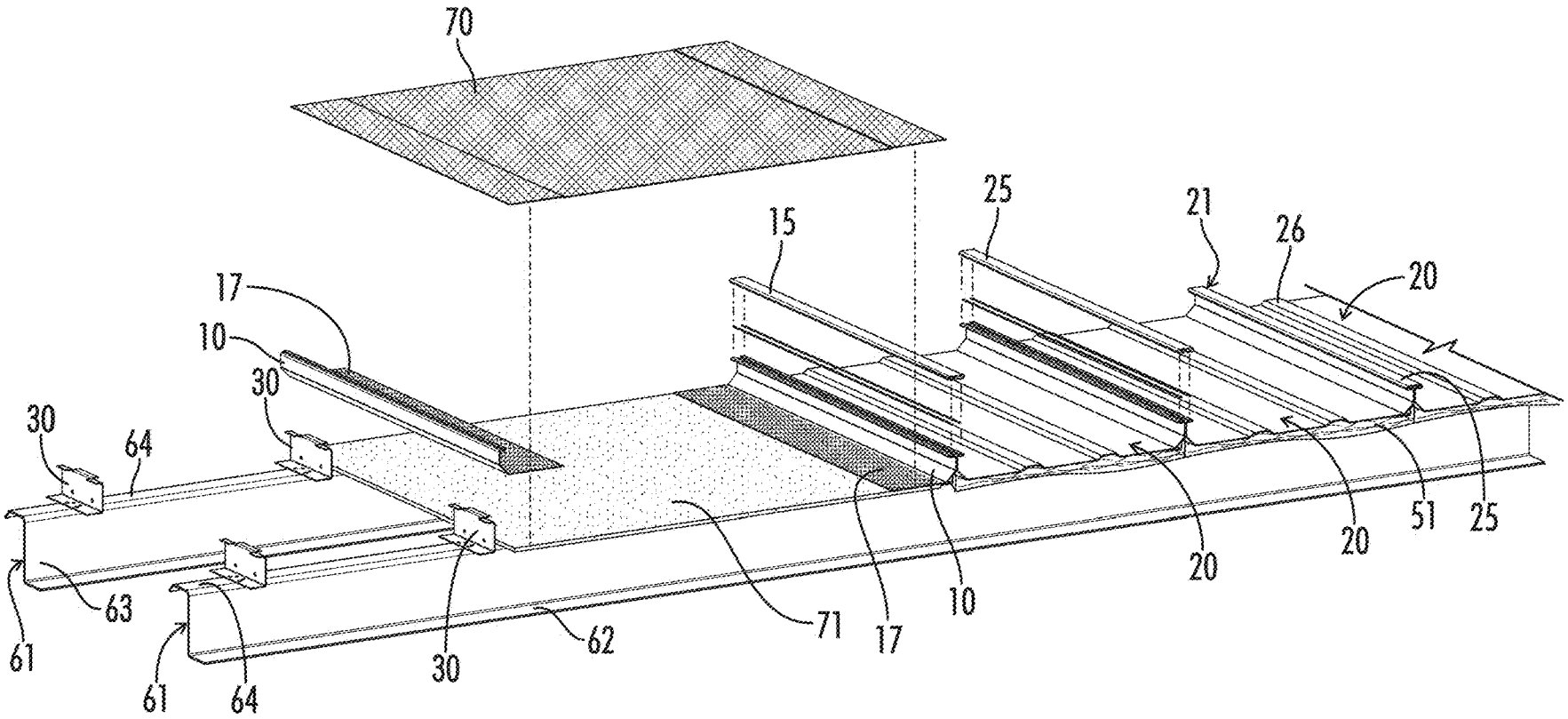
FIG. 2 is a perspective, partially exploded view of a portion of novel hybrid roof cover 5 taken generally from an area 2 of FIG. 1, (certain components of novel hybrid roof cover 5 having been omitted therefrom).

In the drawings and in the description that follows, like parts are identified by the same reference numerals. The drawing figures are not necessarily to scale. Certain features of the invention may be exaggerated in scale or in somewhat schematic form and some details of conventional design and construction may not be shown in the interest of clarity and conciseness.

DESCRIPTION OF ILLUSTRATIVE EMBODIMENTS

The present invention generally relates to hybrid roof covers having a metal panel field and a membrane field. A novel metal standing seam transition roof panel provides a transition between the metal panel field and the membrane field. Some of the embodiments are described in detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

Preferred Hybrid Roof Cover Systems

Various preferred embodiments of the novel metal standing seam transition roof panels are used in a hybrid roof cover system that has a metal panel field and a membrane field. The metal transition panel has a first lateral edge that forms a sidelap with an adjacent panel in the metal panel field. A planar portion extends from the first lateral edge to a second lateral edge. A polymer layer is bonded to at least the upper face of the planar portion. The membrane in the membrane cover is attached to the metal transition panel by a bond formed with the polymer layer.

For example, a first preferred embodiment 5 of the novel hybrid roof covers and components thereof are shown in FIGS. 1-11. As best appreciated from FIGS. 1-5, novel hybrid roof cover 5 generally comprises first, second, third, and fourth metal panel fields 6A, 6B, 6C, and 6D and first and second membrane fields 7A and 7B. First preferred embodiments 10 of the novel metal standing seam transition roof panel joins metal panel fields 6 to membrane fields 7. A first metal transition panel 10 joins metal panel field 6B to membrane field 7A, a second metal transition panel 10 joins membrane field 7A to metal panel field 6C, and so forth.

The upper ends of metal panel fields 6 and membrane fields 7, as may be seen in FIG. 1, extend under a ridge cap 8 provided along a peak line 9 of hybrid roof cover 5. Hybrid roof cover 5 includes large, central field zones F, edge zones E, and corner zones C.

Metal panel fields 6 generally comprises a plurality of conventional metal roof panels 20, individual clips 30, continuous clips 40, and purlins 61. Membrane fields 7 generally comprise a membrane 70 and a support board 71. As discussed further below, metal transition panel 10 generally comprises an upturned side 13, that allows transition panel 10 to be joined to panels 20 in metal panel fields 6, and a polymer layer 17, that allows membrane 70 of membrane fields 7 to be joined to transition panel 10.

The novel hybrid roof covers preferably will be laid out such that any projections extending through the roof extend through a membrane field. For example, in hybrid roof cover 5 a vent pipe 3 (shown schematically) extends through each of membrane fields 7A and 7B. The novel hybrid roof covers thus provide the benefits of both metal panel covers and membrane covers. Typically, the vast majority of the roof will be covered by a metal panel field. It will have the extended service life provided by metal panel covers. At the same time, the novel hybrid roof covers can more effectively accommodate projections. Because they extend through a membrane field, projections may be sealed more easily and effectively than if they extended through a metal panel cover.

Preferred Metal Panel Fields

As noted, metal panel fields 6 generally comprises a plurality of conventional metal roof panels 20, individual clips 30, continuous clips 40, and purlins 61. Conventional panel of metal panel fields 6 are substantially identical to metal panels described in U.S. Pat. No. 11,639,604 to C. Smith, Jr. As seen best in FIGS. 8-9, conventional panel 20 has upturned sides 23 that provide lateral edges running along the length of panel 20. A trough 22 extends between sides 23. Preferably, ridges are provided in trough 22, such as ridges 26 that extend lengthwise or vertically through trough 22. Horizontal ridges also may be provided in trough 22 if desired. Sides 23 are bent to provide them with a geometry that allows them to be joined to form a seam or sidelap 21 between adjacent panels 20 in metal panel fields 6 of hybrid roof cover 5, as will be described further below. Sidelaps 21 are elevated above trough 22, and thus, most of the water falling on metal panel fields 6 of hybrid roof cover 5 will be shed through troughs 22.

Figure 5:
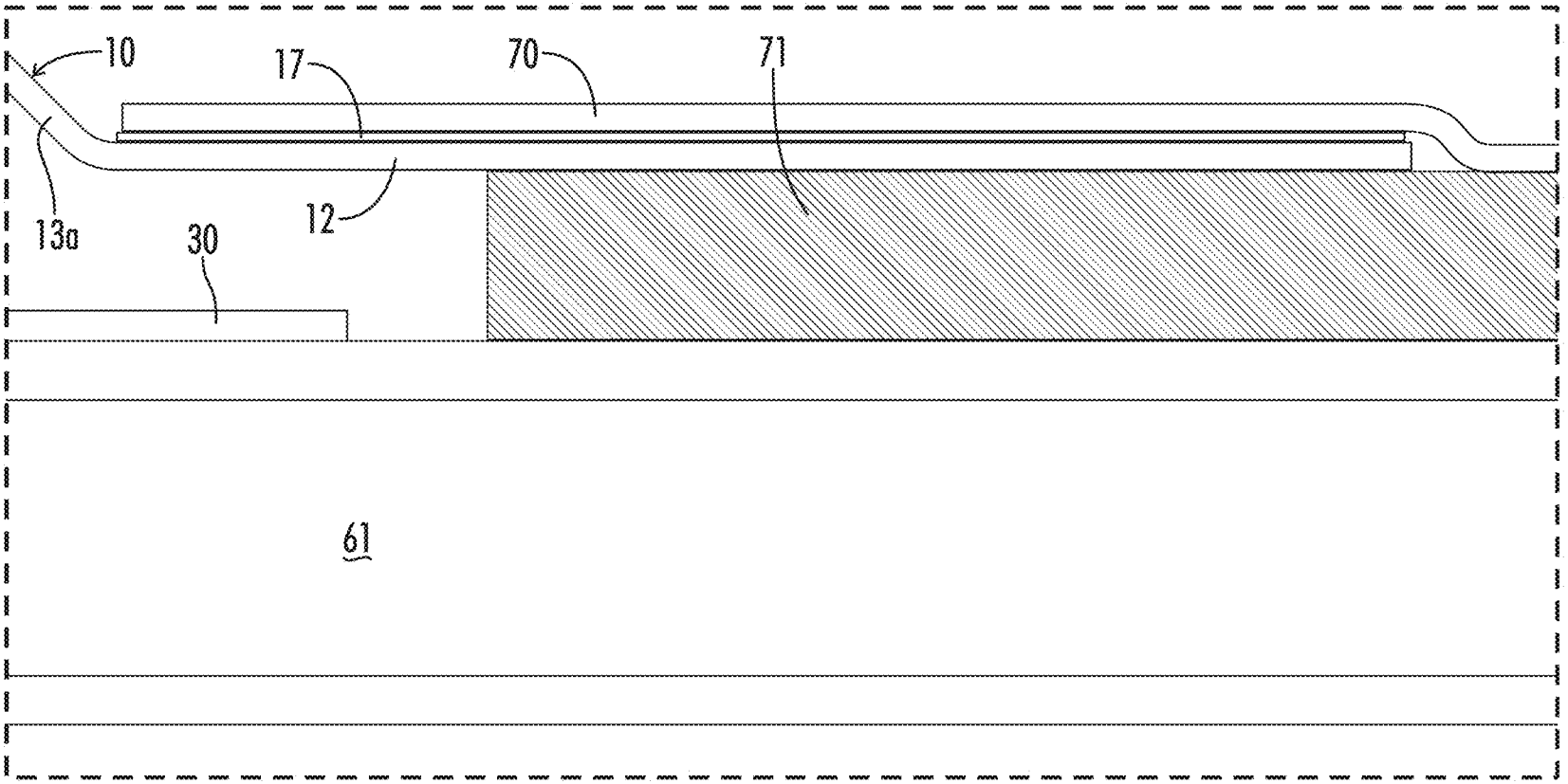
FIG. 5 is an enlarged, detailed view of portion 5 of the view shown in FIG. 4.
Figure 6:
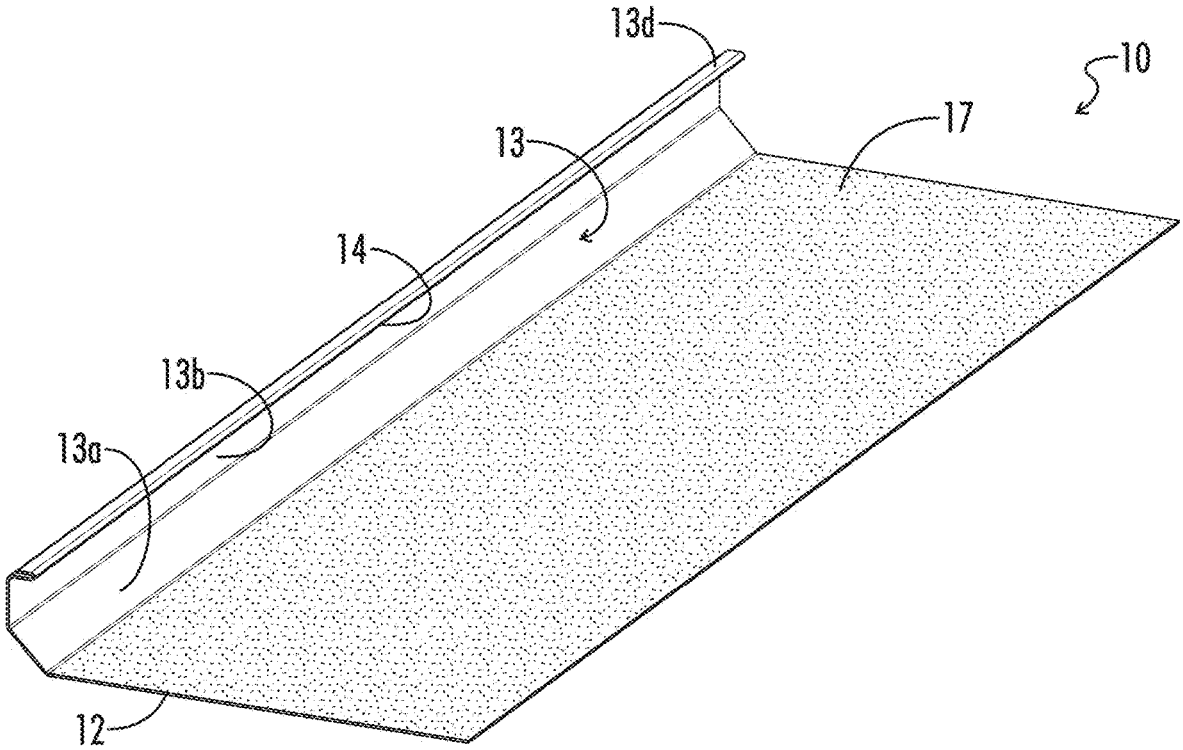
FIG. 6 is an isometric view of a first preferred embodiment 10 of the novel metal standing seam transition roof panels of the subject invention, metal transition panel 10 being used in novel hybrid roof cover 5 shown in FIGS. 1-5.
Figure 8:
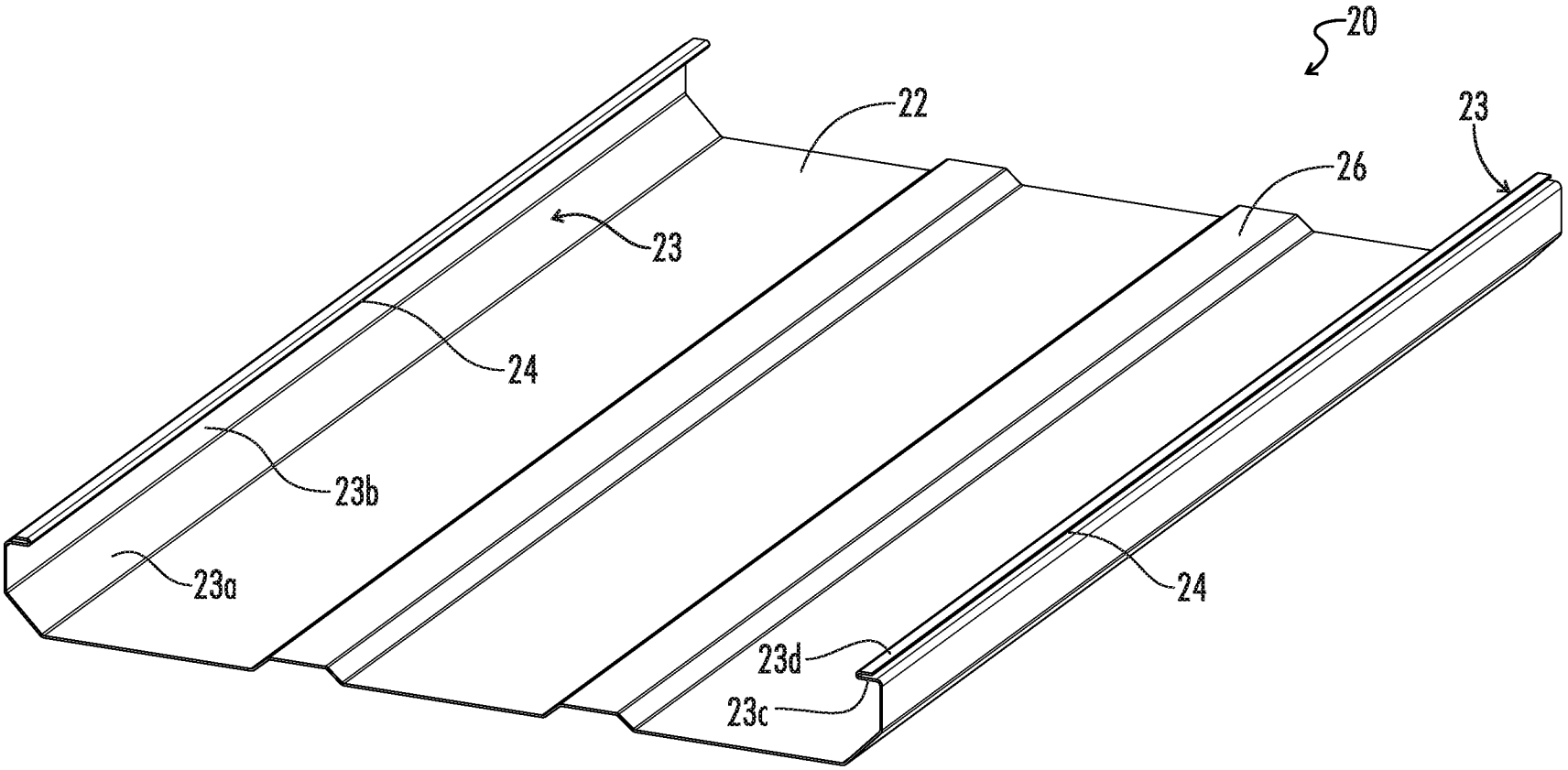
FIG. 8 (PRIOR ART)
FIG. 8 (prior art) is an isometric view of a conventional metal standing seam roof cover panel 20 used in metal panel field 6 of novel hybrid roof cover 5 shown in FIGS. 1-5.
Figure 9:
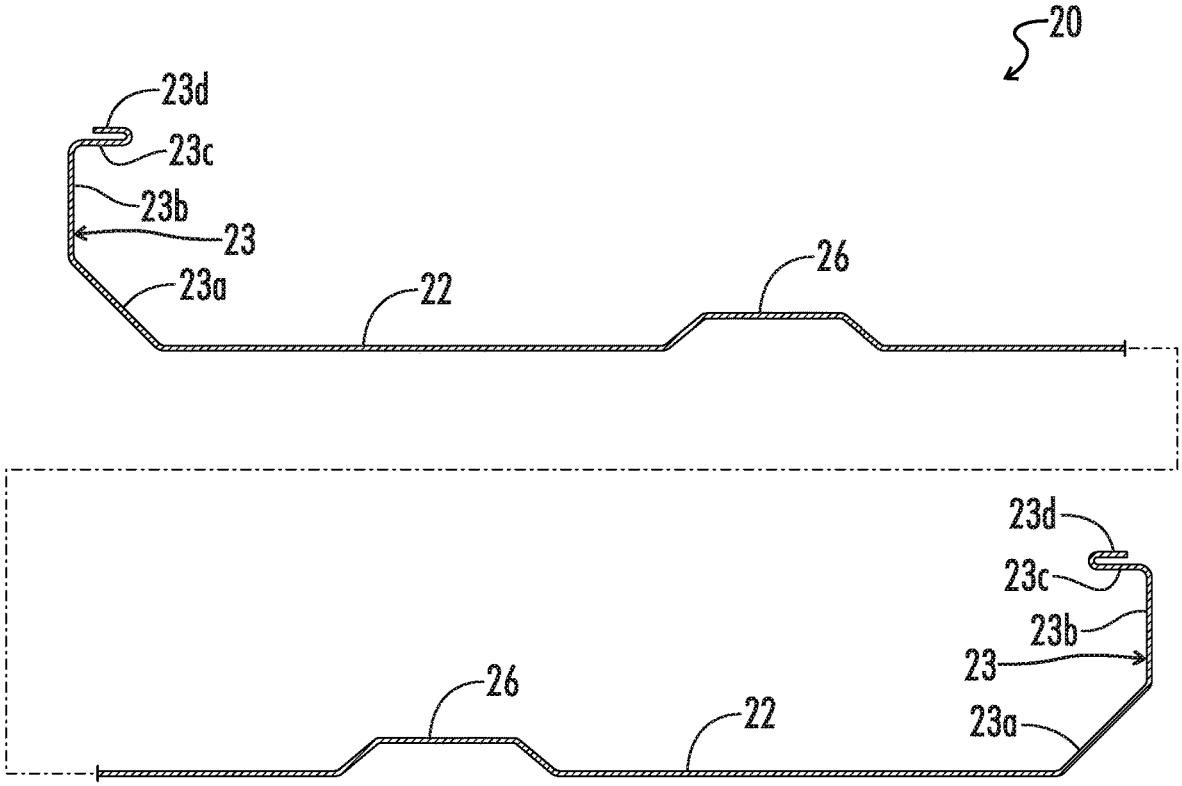
FIG. 9 (PRIOR ART)
FIG. 9 (prior art) is a lateral cross-sectional view of conventional metal panel 20 shown in FIG. 8.

More specifically, and as best appreciated from the cross-sectional views of FIGS. 5-6 and 8, sides 23 of conventional panels 20 comprise an angled portion 23*a*, a vertical portion 23*b*, a first horizontal portion 23*c*, and a second horizontal portion 23*d*, all formed by bends in panel 20 and running the length of panel 20. Angled portion 23*a* extends upward and outward from trough 22. Vertical portion 23*b* extends upward from angled portion 23*a* and generally perpendicular trough 22. First horizontal portion 23*c* extends inward from vertical portion 23*b* and generally parallel to trough 22. Second horizontal portion 23*d* extends above, outward from, and generally parallel to first horizontal portion 23*c*. First and second horizontal side portions 23*c* and 23*d* are doubled over horizontally to form a narrow U-shaped channel 24 that runs vertically along the top of each side 23 of panels 20.

Conventional panel 20 is referred to as a symmetrical panel. That is, sides 23 of panel 20 are mirror images of each other and have a longitudinal plane of symmetry. Panels 20 also are standing seam panels. That is, as described further below, sidelaps 21 between adjacent panels are formed on clips 30 and 40 without the use of penetrating fasteners. When panels 20 are joined by sidelaps 21 and viewed in cross-section as in FIGS. 3-5, sides 23 form what may be viewed as a bisected triangular shape, the base of which is an imaginary line extending along the plane of trough 22. Thus, conventional panels 20 may be referred to as "triangular," symmetrical, standing seam, metal panels. They are commercially available from McElroy Metal Mill, Inc., Bossier City, Luisiana under the Trap Tee trademark.

Panels 20 in metal panel fields 6 may be installed in various ways as described in the aforementioned Smith '604 patent. Thus, as shown in FIGS. 2-5, panels 20 in metal panel fields 6 are installed on a support frame that comprises an array of spaced, elongated bar joists or purlins 61. Purlins 61 are mounted on structural rafter beams (not shown) of a roof substructure. They run "horizontally" through the roof That is, purlins 61 are installed and run across the slope of a roof, as opposed to running "vertically" or with the slope. Panels 20 are installed such that they, and sidelaps 21 joining adjacent panels 20 run vertically across purlins 61. The upper ends of panels 20 extend under ridge cap 8 provided along peak line 9 of hybrid roof cover 5. Preferably, each panel 20 runs down the entire slope of hybrid roof cover 5 to an eave or valley (not shown). Alternately, panels may be overlapped at their ends.

Purlins 61 may be any type of elongated support member, but are exemplified herein as "Z" purlins of the type widely used in metal roofs and building covers. As seen best in FIG. 2, purlins 61 have a flange 62 extending generally horizontally in one direction from the lower end of a vertically oriented body 63. Another flange 64 extends generally horizontally in the other direction from the upper end of body 63. Lower flange 62 provides a base by which purlins 61 are attached to the rafter beams (not shown). Upper flange 64 provides a surface upon which is mounted hybrid roof cover 5. Lower flange 62 and upper flange 64 also preferably and typically are provided with angled edges to provide greater structural integrity and strength to purlin 61.

Panel clips are used to secure the panels to the cover support and to facilitate the formation of standing seams between the panels and between the panels and the transition panels. Individual clips 30, for example, are used to secure cover panels 20 to purlins 61 and to facilitate the formation of seams 21 between laterally adjacent panels 20 as shown in FIGS. 2-5.

Preferred embodiments of the subject invention include metal panel fields in which individual panel clips are installed in portions of the metal panel field extending across central field zones of the hybrid roof cover and continuous clips are installed in corner zones, and where either individual or continuous clips are installed in edge zones of the roof cover. For example, novel hybrid roof cover 5 includes central field zone F, edge zones E, and corner zones C as shown in FIG. 1. Individual panel clips 30 are installed in those portions of metal panel fields 6 extending through central field zone F and edge zones E and continuous clips 40 are installed in corner zones C.

Figure 3:
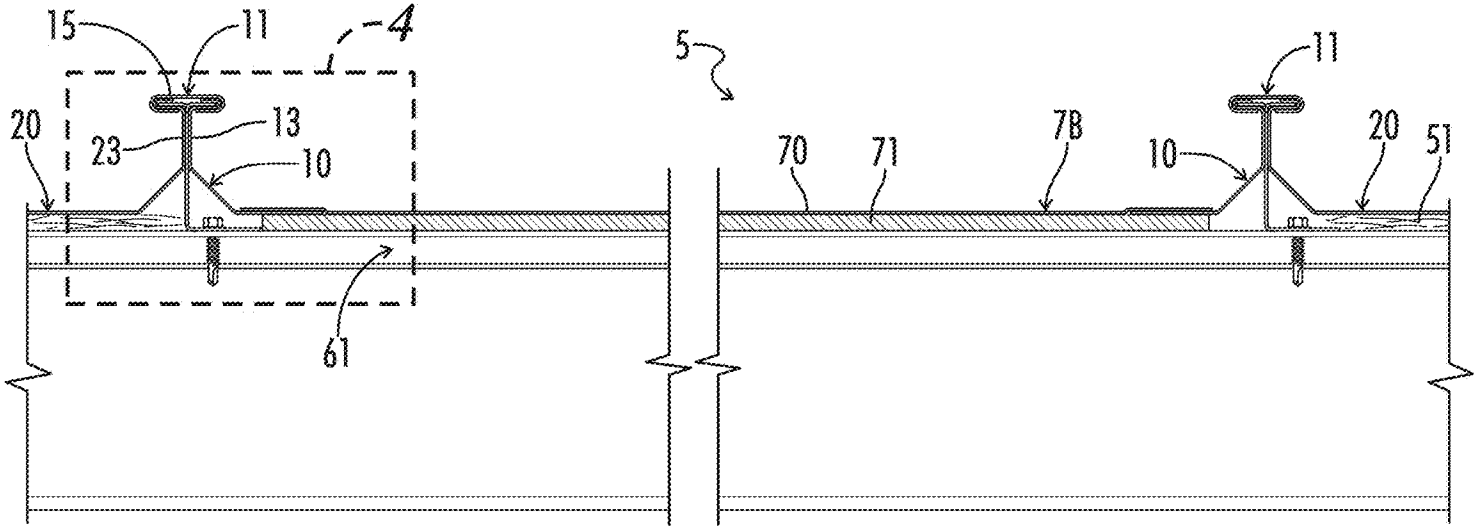
FIG. 3 is a cross-sectional view taken generally perpendicular to standing seams 21 in metal panel field 6 and across membrane field 7 of novel hybrid roof cover 5 shown in FIGS. 1-2.
Figure 4:
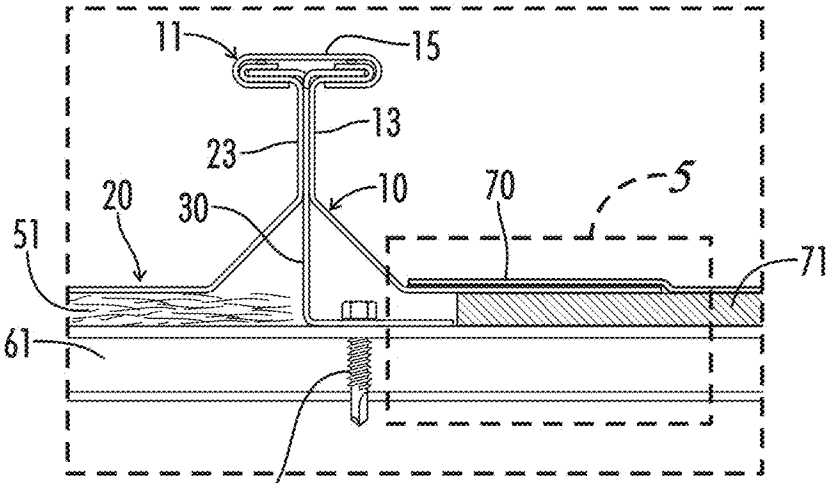
FIG. 4 is an enlarged, detailed view of portion 4 of the view shown in FIG. 3.

Individual clips 30 are mounted on purlins 61 in linear arrays. The arrays of individual clips 30 run vertically across purlins 61 and through central field zone F and edge zones E of hybrid roof cover 5 along what will become the seam lines for cover panels 20. Thus, the linear arrays of clips 30 are separated horizontally by a distance substantially equal to the width of cover panels 20. Individual clips 30 typically will be installed on every purlin 61 along the seam line, for example, by fasteners, such as self-tapping metal screws 28 as shown in FIGS. 3-4.

Continuous clips 40 are installed in corner zones C of hybrid roof cover 5. They may be attached to purlins 61 by fasteners as are individual clips 30. Like individual clips 30, continuous clips 40 are mounted along what will become seam lines for cover panels 20. Thus, they too are offset from each other by a distance approximately equal to the width of panels 20. In contrast to individual clips 30, however, continuous clips 40 are elongated and extend across adjacent purlins 61. Continuous clips 40, therefore, provide continuous support for panels 20 through corner zones C, thus providing greater resistance to wind uplift in those areas experiencing the greatest uplift forces. If desired or necessary, increased resistance to wind uplift may be provided in roof edge zones E by providing continuous clips in those zones instead of individual clips as in hybrid roof cover 5.

Figure 10:
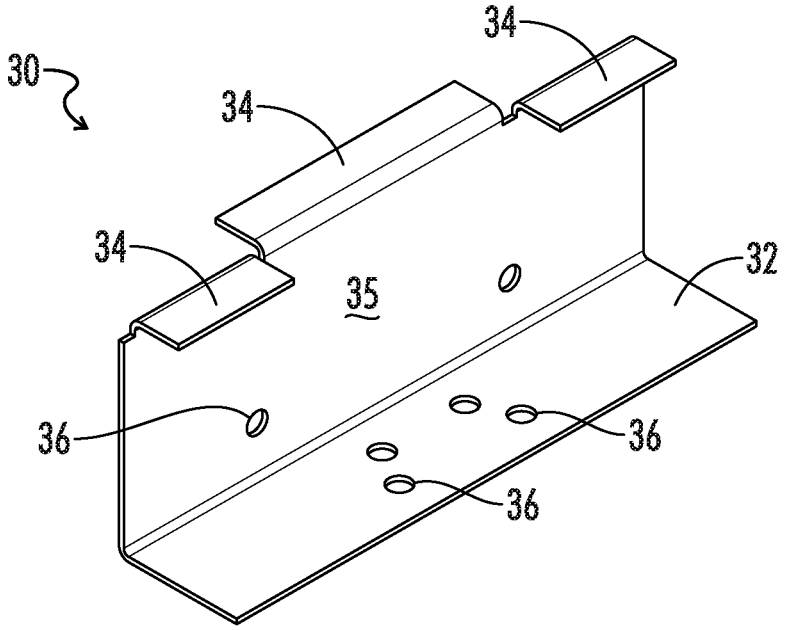
FIG. 10 (PRIOR ART)
FIG. 10 (prior art) is an isometric view of a conventional individual panel clip 30 used in metal panel field 6 of novel hybrid roof cover 5 shown in FIGS. 1-5.

As seen best in FIG. 10, individual clips 30 in field zones F and edge zones E include a bottom flange or base 32 and top flanges 34 that extend generally horizontally from a vertically oriented web or body 35. Individual clips 30 are attached to purlins 61 by fasteners, such as self-tapping, metal screws 28, extending through bottom flange 32 of clips 30 and top flange 64 of purlins 61. Preferably, preformed round apertures 36 are provided in base 32 of individual clips 30 to accommodate screws 28 or other fasteners. If desired, however, slots may be provided, or screws may be driven through base 32.

It will be appreciated that a greater or lesser number of screws 28 or other fasteners may be used to mount individual clips 30 to purlins 61. Typically, at least two fasteners will be used to resist torque about the connections and to provide greater stability for individual clips 30. Additional screws 28 or other fasteners may be used when more stability and strength is required in the connection between individual clips 30 and purlins 61.

The length of clips 30 and base 32 thereof, as well as the placement, configuration, and number of apertures 36, preferably are coordinated to allow for some imprecision in placement of clips 30 during installation while ensuring that a sufficient number of fasteners may be driven into purlins 61. It also is preferable that individual clip 30 and base 32 be sufficiently long so as to allow for a more stable and secure connection to purlins 61.

Top flanges 34 provides support for cover panels 20 and facilitate the formation of standing seams 21 between cover panels 20. As cover panels 20 are installed, U-shaped channels 24 in the upper portion of sides 23 of panels 20 are slipped over top flanges 34 of clips 30. A seam cover 25 then is provided over and around side portions 23*c* and 23*d*, that is, the exterior of channel 24 to secure panels 20 to each other and to clips 30. Preferably, a sealant, such as a bead of silicone caulk or elastomeric tape, is provided between seam cover 25 and the exterior of channels 24 to enhance the weather tightness of seams 21. A seamer also may, and preferably is used to securely connect and seal seam cover 25 to panel sides 23. Transition panel 10 will be connected and seamed to an adjacent panel 20 in the same manner.

The exact dimensions of top flanges in the individual clips are not especially critical and may be varied somewhat to provide as much or as little support surface as may be desired or necessary for a particular installation. Likewise, clips 30 have three top flanges 34, two flanges 34 extending in one direction and one flange 34 extending in an opposite direction. Other clips, however, may be provided with any number of top flanges extending in alternating directions.

Figure 11:
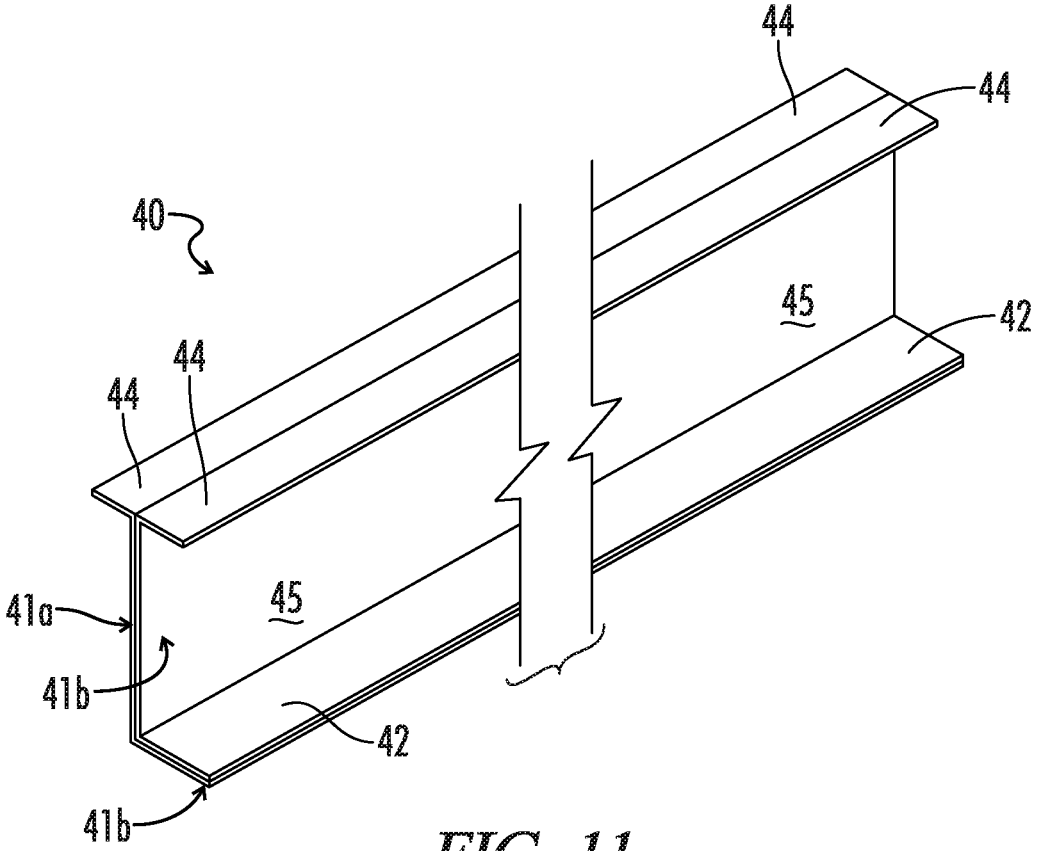
FIG. 11 (PRIOR ART)
FIG. 11 (prior art) is an isometric view of a conventional continuous panel clip 40 used in metal panel field 6 of novel roof cover 5 shown in FIGS. 1-5.
Figure 12:
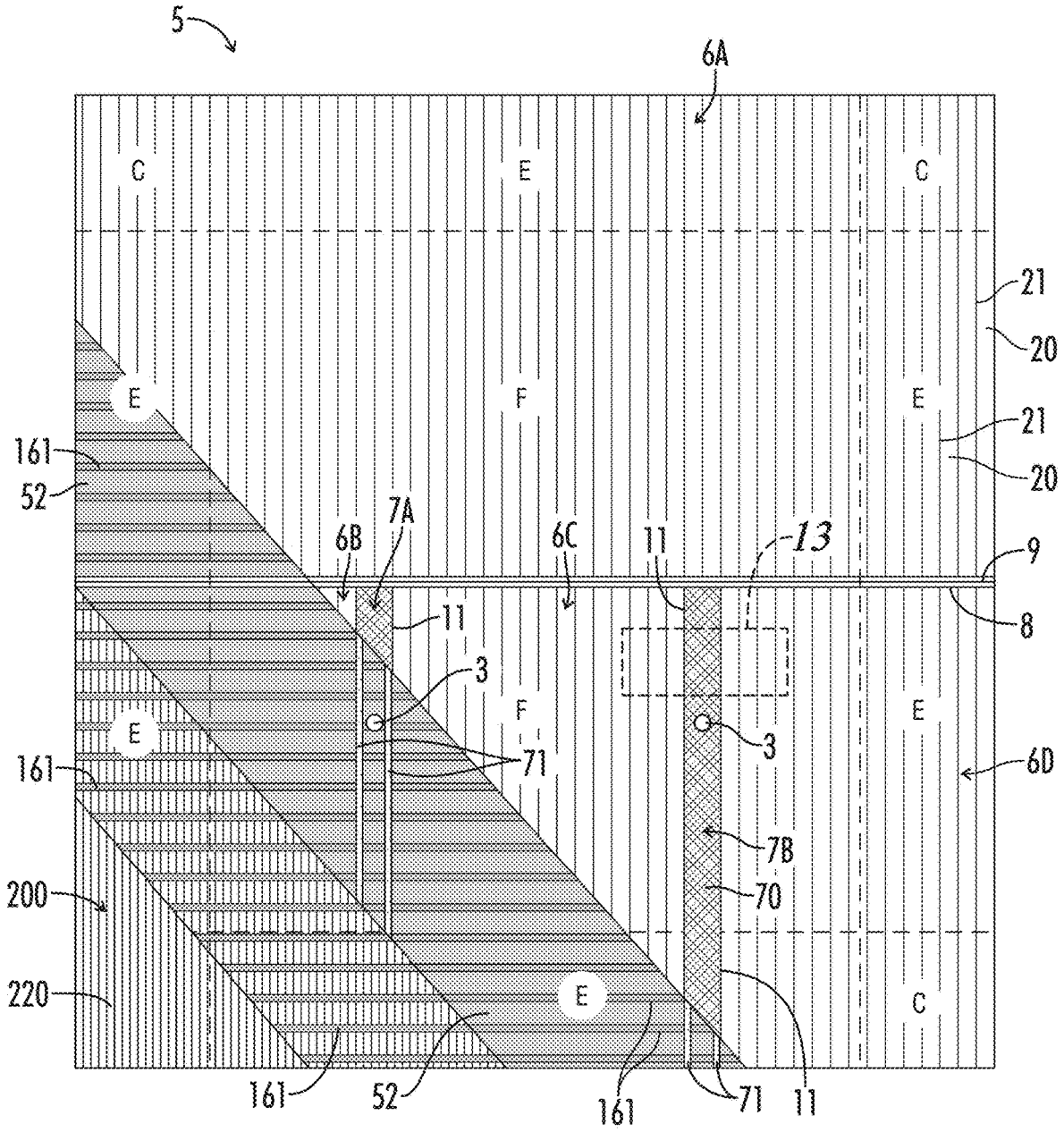
FIG. 12 is a plan view, having partial tear-away views, of a conventional metal panel roof 200 which has been recovered with novel hybrid roof cover 5.

Continuous clips 40, as seen best in FIG. 11, are formed from two similar, nesting components 41*a* and 41*b*. More particularly, clip components 41 have a bottom flange 42 and a top flange 44 extending generally horizontally from a vertically oriented web or body 45. They are substantially identical except that top flange 44 of clip component 41*a* and top flange 44 of clip component 40*b* extend in opposite directions. Body 45 of clip component 41*b* also is slightly shorter than body 45 of clip component 41*a*, such that when clip components 41 are nested together, their top flanges 44 will be substantially aligned.

Continuous clips 40 are attached to purlins 61 in a manner similar to individual clips 30. Fasteners, such as self-tapping, metal screws, may be driven through bottom flanges 42 of clips 40 and top flange 64 of purlins 61. As with individual clips 30, a greater or fewer number of fasteners may be used as required to provide the necessary strength of connection. Continuous clips 40, because of their extended length, typically will be fabricated from lighter gauge metal, and thus, self-tapping metal screws typically can be driven easily through them during installation. If desired, however, prefabricated apertures, slots, and the like may be provided therein to accommodate screws or other fasteners.

The length of clip components 41 is coordinated such that clips 40 span at least the distance between adjacent purlins 61, but preferably such that clips 40 extend across all purlins 61 in the corner zone of hybrid roof cover 5. The width of base 42, as well as the placement, configuration, and number of any apertures present, preferably are coordinated to allow for some imprecision in placement of clip components 41 during installation while ensuring that a sufficient number of fasteners may be driven into purlins 61.

Top flanges 44 of continuous clips 40, similar to top flanges 34 in individual clips 30, engage adjacent panels 20 and transition panels 10 and assist in the formation of standing seams 21 therebetween. More particularly, top flanges 44 are configured such that sides 23 of panels 20 and side 13 of transition panels 10 may be engaged therewith by slipping U-shaped channels 24 around top flanges 44. Seam cover 25 then is placed over and around, for example, channels 24 to secure panels 20 to each other and to continuous clips 40. Sealants and seamers also are preferably used to form a secure, weather tight seam along continuous clips 40.

It also will be appreciated that panels 20 provide various advantages over other conventional panel designs. They have a sufficient degree of load resistance that allow them to be used as structural panels and installed over a support system having spaced purlins. They also are symmetrical panels. Installation of panels 20 may proceed in either direction, and if damaged after installation in hybrid roof cover 5, individual panels 20 can be replaced without removing any adjacent panels 20. The profile of panels 20 is relatively simple and allows them to be formed on smaller, less capable roll formers that can be transported to a job site. Because they can be formed on site, in most cases they can be run in lengths sufficient to cover the entire slope of the roof.

At the same time, however, other symmetrical panels, both structural and architectural, may be used in the metal panel fields of the novel hybrid roof covers. A number of designs for symmetrical panels are known in the art may be used as desired, such as those disclosed in U.S. Pat. No. 8,887,464 to C. Smith, Jr. Those panels are commercially available from McElroy Metal Mill and are sold under the 138T and 238T trademarks.

Likewise, while individual clips 30 and continuous clips 40 are used in preferred embodiments of the novel roof recovers, the invention is not limited thereto. Other clip configurations may be used if desired. For example, while individual clips 30 in novel hybrid roof cover 5 are a unitary component, other individual clips suitable for use in other embodiments of the subject invention may have a two-piece design, similar to continuous clips 40. Likewise, continuous clip 40 may be fabricated as a unitary component, analogous to individual clips 30. The various flanges in the exemplified clips are integral with their associated clip body. If desired, however, the various flanges may be provided as separate components affixed to a clip body, e.g., by welding. Other suitable clip designs are known and may be used in the novel hybrid roof covers, such as those disclosed in the aforementioned Smith '604 patent.

The clips used in the novel metal panel roof recovers preferably are made from steel, such as 16 to 24-gauge galvanized steel sheets that may be easily formed and bent and cut into a desired configuration by conventional metal forming equipment. Such materials provide a rugged, weather resistant clip that may be manufactured easily and economically. Continuous clips, given their length, may be made from somewhat lighter gage metal if desired to reduce costs and to allow screws to be driven more easily through the clip instead of providing apertures to accommodate fasteners. Other metals, such as extruded aluminum, may be used to fabricate the panel clips, however, as well as rigid, moldable or extrudable plastics.

Any of the wide variety of insulating materials commonly used in building construction to reduce heat transfer by conduction, radiation, or convection may be used in the novel metal hybrid roof covers. Such insulating materials include polyurethane, isocyanate, and other spray foam insulation, cotton, rock and slag wool, fiberglass, and other fibrous bats and blankets, cellulose and other blown-in fibrous insulation, and is expanded or extruded closed cell polystyrene (EPS and XPS), polyisocyanate, and other rigid plastic foam insulation. Various barrier sheets, films, coatings, and facing also may be provided to provide additional thermal resistance, to minimize water condensation in the insulation, or to provide fire resistance to the insulation.

The choice of insulating materials will depend in large part on the degree of thermal resistance desired, cost considerations, and the supporting structure on which the cover is installed. When novel hybrid roof cover 5 is installed over purlins 61, for example, batts 51 of fiberglass or other fibrous insulating materials may be used in metal panel field 6. Batts 51 may be laid across the array of purlins 61 and clips 30 and 40 installed over batts 51. The height of clips 30 and 40 typically will be such that a small clearance, appropriate for the thickness of the batts 51 used, will be provided between the bottom of panels 20 and the top flange 64 of purlins 61. Similarly, foam boards or other thermally insulating supports may be laid over purlins 61 and clips 30 and 40 installed over the support. Alternately, foam boards may be provided between purlins 61 and clips 30 and 40 installed directly on purlins 61. Other ways of providing insulation underneath the cover are known and may adapted and modified readily by workers in the art for use in the novel hybrid roof covers.

It also will be appreciated that the metal panel fields of the novel hybrid roof covers almost invariably require the use of other components to complete certain portions of a cover installation. For example, if there are multiple, intersecting metal panel fields, ridge caps will be provided along the peak and hip lines of the cover, and specialized connectors may be required for their installation. Similarly, flashing may be installed in roof cover valleys. Facia and soffit components also may be installed along the eaves and gables of the roof. A wide variety of such components and installation methods are known in the art and may be used in the novel hybrid roof covers.

Novel hybrid roof cover 5 has been illustrated as installed over a frame comprising an array of purlins 61. It will be appreciated, however, that the novel hybrid roof covers may be installed on a variety of support structures. They may be installed over a deck, for example, and some building owners may prefer a deck despite the increased cost. A deck provides additional support for the panels and also facilitates the use of foam insulation boards in the cover.

Preferred Membrane Fields

Membrane fields 7, as noted, generally comprise a membrane 70 and a support board 71. Like metal panel fields 6, membrane fields 7 incorporate conventional materials. Membrane 70 preferably will be a single web extending across the entire membrane field 7, but more commonly will be made up of discrete sheets of membrane that are seamed together at their edges.

Membrane 70 can be any of the thermoset and thermoplastic membranes used in conventional single-ply membrane covers. For example, membrane sheets 70 in membrane fields 7 of novel hybrid roof cover 5 incorporate a membrane sheet composed of polyvinyl chloride (PVC), a thermoplastic polymer. Membrane 70, however, may be fabricated from thermoset membrane sheets, such as polymerized ethylene propylene diene monomer (EPDM) membrane sheets. They also may be other types of thermoplastic membranes, such as polyolefin (TPO) and ketone ethylene ester (KEE) membranes. Such materials typically will be from about 50 to about 60 millimeters (mm) thick. A variety of membranes suitable for use in the novel hybrid roof covers are available commercially. For example, PVC membranes are available from IB Roof Systems, Grapvine, Texas (www.ibroof.com), Fiberlite, Wooster, Ohio (fiberlite.com), and Sika Corporation, Lyndhurst, New Jersey (usa.sika.com/en/construction/building-envelope/roofing-waterproofing/sika-sarnafil-roofing-systems.html).

Support board 71 may be provided by any of the conventional board and sheet products conventionally used in decking and subroofs to provide support for membrane covers. Most commonly, support board 71 will be provided by wood products, such as sheets of plywood, oriented strand board (OSB), or wood fiber board. Less commonly, wood planking may be used. Other materials that may be suitable, depending on the installation, include gypsum board, fiber-reinforced or faced gypsum board, cement boards, perlite boards, asphaltic boards, mineral fiber boards. Rigid foam boards, such as high-density poly isocyanate boards also may be used.

Figure 13:
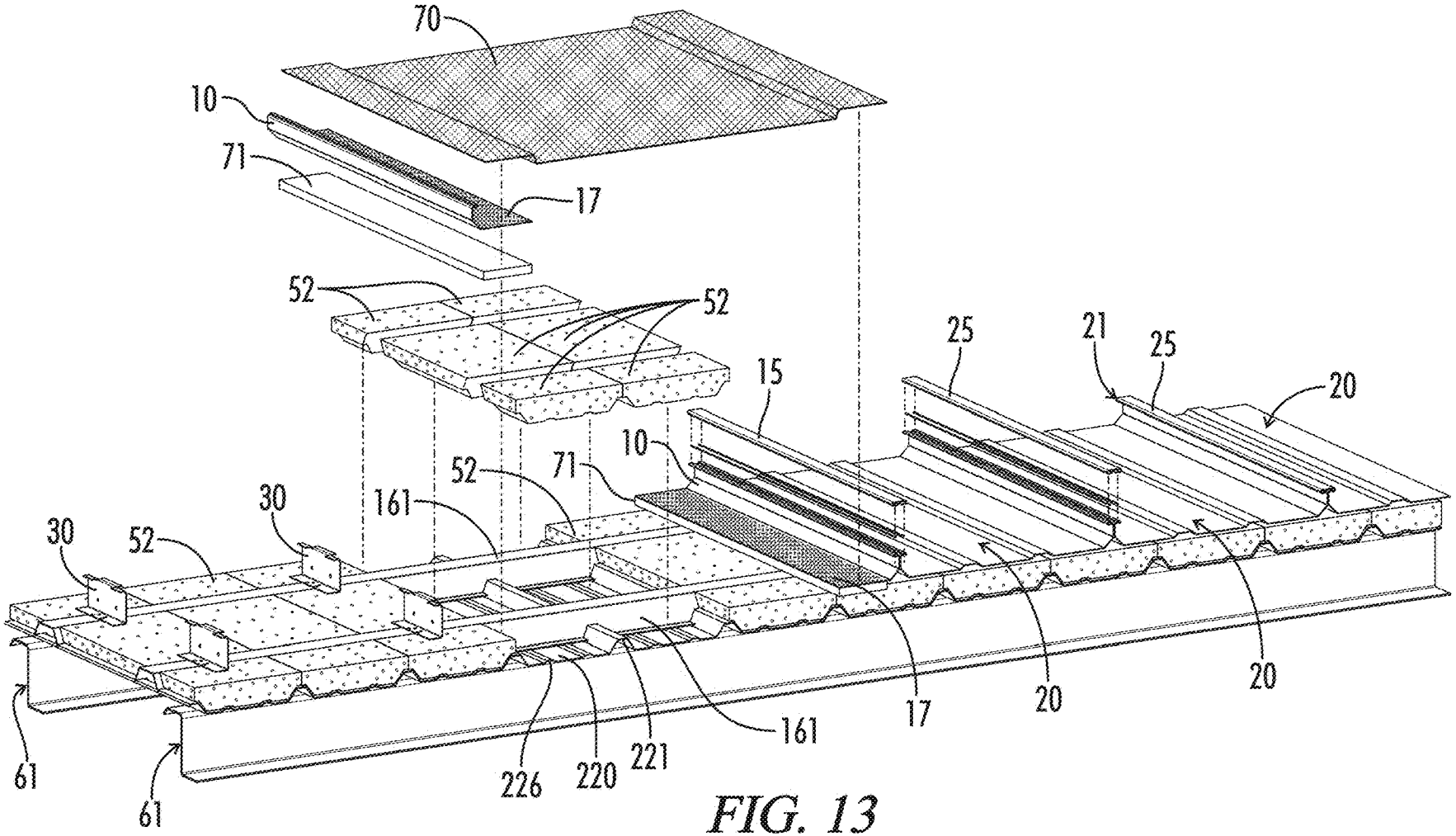
FIG. 13 is an isometric, partially exploded view of a portion of novel hybrid roof cover 5 installed over existing roof 200 taken generally from an area 13 of FIG. 12, (certain components of novel hybrid roof cover 5 having been omitted therefrom to better show is underlying components).
Figure 14:
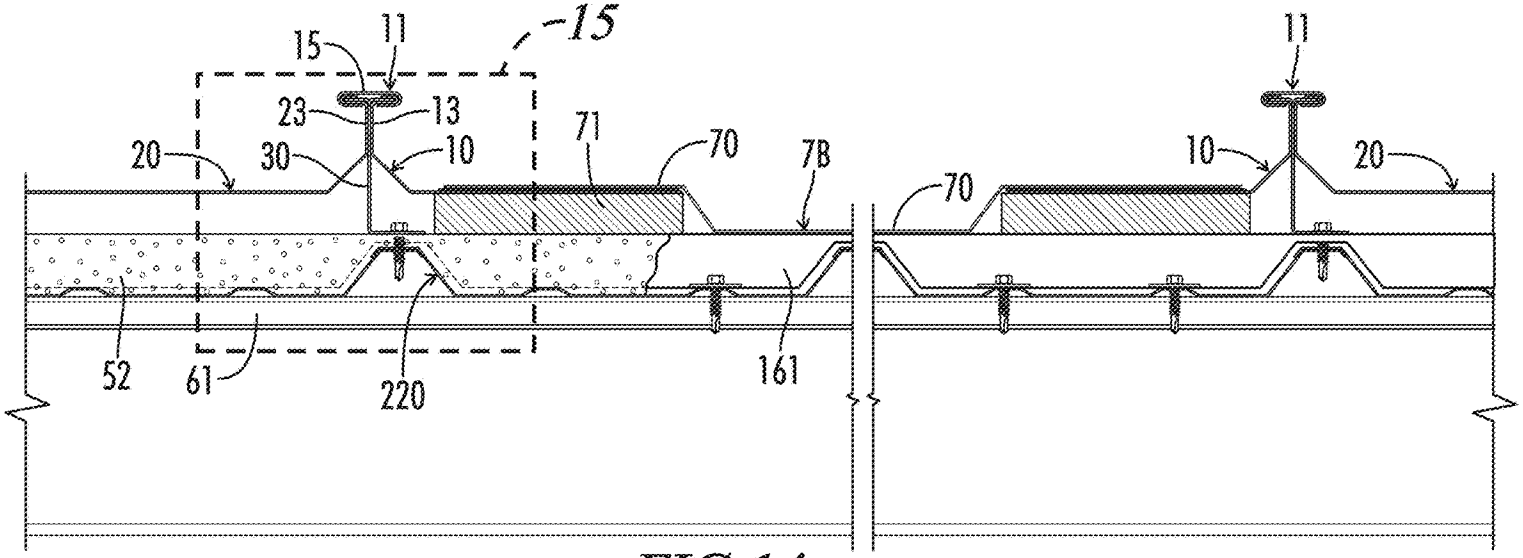
FIG. 14 is a cross-sectional view, taken generally perpendicular to standing seams 21 of metal panel field 6 and across membrane field 7 of novel hybrid roof cover 5 installed over existing roof 200 shown in FIGS. 12-13.
Figure 15:
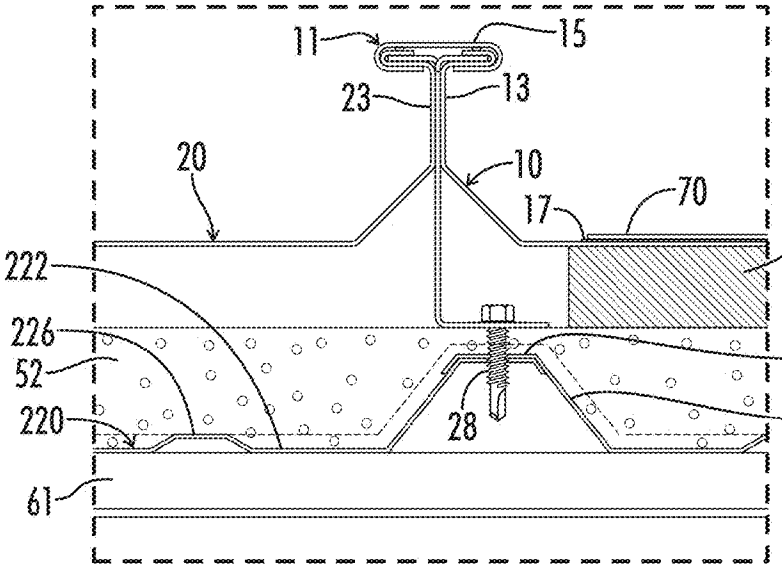
FIG. 15 is an enlarged, detailed view of portion 14 of the view shown in FIG. 14.

Support board 71 will be secured to the roof support frame and preferably will extend across the full extent of membrane field 7. For example, as shown in FIGS. 13-15, support board 71 may be mounted across purlins 61 by penetrating fasteners. Membrane 70 extends over and is attached to support board 71. It may be attached by conventional means. For example, a liquid adhesive may be used to bond membrane 70 to support board 71, either continuously or in select areas. Membrane 70 also may be attached to support board 71 by mechanical fasteners. Any conventional method may be used to secure membrane 70 to support board 71.

Preferred Novel Metal Transition Panels

As mentioned, the novel metal transition panels allow metal panel roof covers to be joined to membrane covers. Metal transition panel 10, for example, generally comprises an upturned side 13, that allows transition panel 10 to be joined to panels 20 in metal panel fields 6, and a polymer layer 17, that allows membrane 70 of membrane fields 7 to be joined to transition panel 10.

Figure 7:
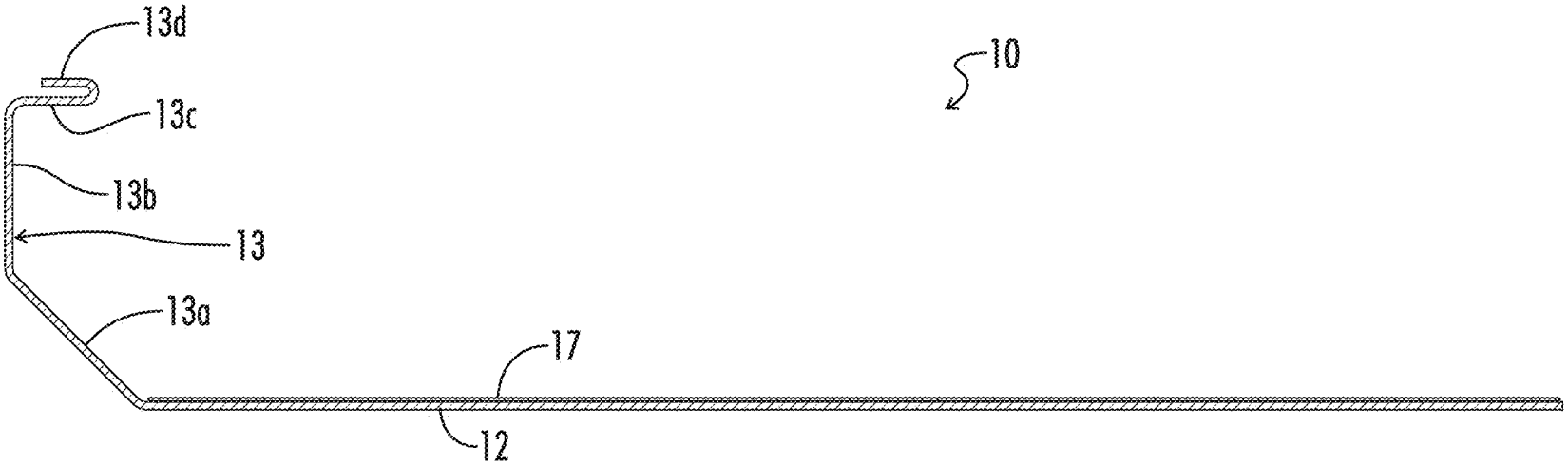
FIG. 7 is a lateral cross-sectional view of novel metal transition panel 10 shown in FIG. 6.

More specifically, as seen best in FIGS. 6-7, metal transition panel 10 has an upturned side 13 that provides a lateral edge running the length of transition panel 10. A flat or planar portion 12 extends horizontally from upturned side 13 to the other lateral edge of transition panel 10. Upturned side 13 is bent to provide it with a geometry that is symmetrical to sides 23 of panels 20.

That is, side 13 of transition panel 10 comprises an angled portion 13*a*, a vertical portion 13*b*, a first horizontal portion 13*c*, and a second horizontal portion 13*d*, all formed by bends in transition panel 10 and running the length of transition panel 10. Angled portion 13*a* extends upward and outward from planar portion 12. Vertical portion 13*b* extends upward from angled portion 13*a* and generally perpendicular to planar portion 12. First horizontal portion 13*c* extends inward from vertical portion 13*b* and generally parallel to planar portion 12. Second horizontal portion 13*d* extends above, outward from, and generally parallel to first horizontal portion 13*c*. First and second horizontal side portions 13*c* and 13*d* are doubled over horizontally to form a narrow U-shaped channel 14 that runs vertically along the top of side 13 of transition panel 10. Side 13 of transition panel 10, therefore, will be a mirror image of side 23 of an adjacent panel 20, and transition panel 10 also will be referred to as a symmetrical panel.

Upturned side 13 thus may be joined to form a transition panel sidelap 11 with a side 23 of an adjacent panel 20 in metal panel fields 6 in the same manner in which panels 20 are seamed together in metal panel field 6. U-shaped channel 14 in side 13 of metal transition panel 10, and U-shaped channel 24 in side 23 of the adjacent panel 20, are slipped is around top flanges 34 in clips 30 (or top flanges 44 in clips 40 as the case may be). Transition panel sidelap 11 then is completed by installing and sealing a transition panel seam cover 15 substantially identical to seam covers 25.

Polymer layer 17 is bonded to the upper face of planar portion 12 of metal transition panel 10. It forms a wide strip running the length of transition panel 10, substantially covering planar portion 12. Polymer layer 17 is a thermoplastic PVC film that is heat bonded to transition panel 10. Typically, polymer layer 17 will be from about 25 to 35 mm thick. Other polymers, however, may be used to provide polymer layer 17. For example, polymer layer 17 may be provided by bonding a thermoset polymer film, such as polymerized ethylene propylene diene monomers (EPDM) membranes, to transition panel by adhesives or a chemical weld. Polymer layer 17 also may be provided by other thermoplastic films, such as polyolefin (TPO) and ketone ethylene ester (KEE) films that are heat welded or adhered to transition panel 10.

Polymer layer 17 allows membrane 70 of membrane field 7 to be bonded to transition panel 10. For example, when membrane 70 and polymer layer 17 both are composed of a thermoplastic polymer, such as PVC, they may be heat welded together. Alternately, and depending on the materials from which they are fabricated, membrane 70 and polymer layer 17 may be solvent welded or adhered together. In general, and again depending on the specific materials from which they are made, membrane 70 and polymer layer 17 may be bonded together in any of the ways in which sheets of membrane are conventionally joined in membrane covers. The extent of planar portion 12 and polymer layer 17 can vary, but at a minimum they will provide sufficient surface area to provide a weathertight seam between transition panel 10 and membrane 70. It also will be appreciated that support board 71 of membrane field 7 extends under planar portion 12 to provide support for the bond between metal transition panel 10 and membrane 70.

The novel transition panels may be fabricated from materials and by methods as are commonly employed in the art to produce conventional metal roof panels. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. The materials and fabrication of metal panels is well known in the art, and conventional materials and fabrication equipment may be used to manufacture the novel transition panels.

The polymer layer may be bonded to the roll stock before forming the transition panel or to the transition panel after it has been formed. Preferably, however, polymer layer 17 is bonded to the roll stock before it is fed into a roll former to form upturned side in transition panel 10. Thus, polymer layer 17 covers substantially all of planar portion 12, but does not cover portions of the roll stock that will be formed into upturned side 13. A polymer layer may be provided over the entire upper face of the roll stock before it is fed into the roll former. The polymer, however, may tend to release from the roll stock as it is shaped and may tend to gum or build up in the roll former.

Preferred Hybrid Roof Recover Systems

The novel hybrid roof covers also may be installed over an existing roof cover. For example, as shown in FIGS. 13-16, novel hybrid roof cover 5 may be installed over a prior art, existing metal roof 200. Existing roof 200 is typical of exposed fastener metal roofs that have been installed in great numbers over the past few decades. As shown generally therein, it includes an array of spaced, elongated bar joists or purlins 61. Purlins 61 are mounted on structural rafter beams (not shown) of a roof substructure and run horizontally through the roof.

As best seen in FIGS. 14-16, panels 220 in existing roof 200 run vertically across purlins 61 and have upturned longitudinal sides 223 that overlap to form raised lap ridges 221. Existing panels 220 also have, as is typical of panels of this type, a number of vertical ridges 226 formed in the trough 222 extending between lap ridges 221. Panels 220 are supported by and attached to upper flange 64 of purlins 61 by penetrating fasteners, such as screws (not shown), which are installed in the troughs 222 of panels 220. Panels 220 also are interconnected by screws or other penetrating fasteners (not shown) installed along overlapping lap ridges 221.

Hybrid roof cover 5 is installed over existing roof 200 in a manner similar to the original installation of hybrid roof cover 5 exemplified above. Panel clips 30 and 40 may be laid out on the surface of existing panels 200, and the fasteners, such as metal screws 28, driven though existing panels 220. Alternately, as best seen in FIGS. 13-16, a notched is recover purlin 161 may be laid over existing panels 220 and fastened to existing panels 220, or fasteners may be driven through existing panels 220 into existing purlins 61.

Preferably, clips 30 and 40 also are made somewhat taller to allow, as shown in FIGS. 14-16, the installation of foam board insulation 52 between existing panels 220 and panels 20. Foam boards 52 have a generally flat, solid rectangular configuration such that they may be placed over existing panels 220 between adjacent rows of clips 30 and 40 with their sides closely abutting each other. The bottom surface of foam board 52 preferably is profiled to mate more or less with the profile of existing panel 220. The bottom surface of foam boards 52, therefore, will be able to rest more or less continuously across the surface of existing panels 220, thus allowing any load transmitted to the foam to be distributed across a wider area. When foam boards 52 will be installed in areas where individual clips 30 are present, cutouts may be provided (not shown), if desired, to accommodate individual clips 30 and facilitate installation of foam boards 52. Wider foam boards spanning across seam lines also may be provided with openings to accommodate individual panel clips.

Foam boards 52 preferably are composed of relatively dense high load capacity rigid plastic foam, such as expanded or extruded closed cell polystyrene. They may comprise facing, such as various barrier sheets, films, and coatings designed to provide a vapor barrier, to reflect radiant heat, or to provide fire resistance, or they may be unfaced. Typically, foam boards 52 will have a load capacity of from about 18 to about 25 pounds per square inch (psi).

Support boards 71 will be provided under planar portions 12 of transition panels 10 in hybrid roof cover 5 as shown in FIGS. 12-15. Membrane 70 of membrane fields 7 elsewhere may be laid directly over foam boards 52. If desired, however, support boards 71 may be provided across membrane fields 7.

It will be appreciated that the novel hybrid roof covers may be installed over existing roof covers of various types in a variety of ways, and many conventional methods are known. For example, the novel hybrid roof covers may be installed over standing seam metal panel roof covers in a manner similar to recover systems disclosed in U.S. Pat. No. 8,938,924 to C. Smith. They may be installed over shingled roof covers in a manner similar to recover systems disclosed in U.S. Pat. No. 9,404,262 to C. Smith. Other methods are known and may be used. Moreover, although illustrated as being installed over an uninsulated is existing roof cover, the novel hybrid roof covers may be installed over insulated roof covers.

Finally, and for the avoidance of doubt, it will be appreciated that the terms "horizontal" and "vertical," and forms thereof, have been used in two senses. In first senses, as applied to the orientation and layout of components within a cover system, the terms are understood in reference to the slope of the roof "Horizontal" denotes that the component is oriented or runs across the slope of the roof, while "vertical" denotes that it is oriented or runs along the slope. In second senses, the terms are understood in reference to the plane of the roof, "horizontal" denoting extension in or generally parallel to the plane and "vertical" denoting extension generally perpendicular to the plane. Workers in the art commonly use the terms in both senses and will readily discern the sense in which they are used in this disclosure.

While this invention has been disclosed and discussed primarily in terms of specific embodiments thereof, it is not intended to be limited thereto. Other modifications and embodiments will be apparent to the worker in the art.

What is claimed is:

1. A metal transition panel for a hybrid roof cover system, said hybrid roof cover system comprising a metal panel field and a membrane field, wherein said metal panel field comprises a plurality of metal standing seam roof panels interconnected by sidelaps along lateral edges of said metal standing seam roof panels and said membrane field comprises a membrane sheet, said metal transition panel being a metal standing seam transition roof panel adapted to provide a transition between said metal panel field and said membrane field and comprising:

(a) an upstanding side defining a first lateral edge of said metal transition panel, wherein said first lateral edge:

i) is symmetrical with a said lateral edge of a said metal standing seam roof panel in said metal panel field of said hybrid roof cover system that is adjacent to said metal transition panel; and ii) is adapted to form a sidelap between said metal transition panel and said adjacent metal standing seam roof panel in said metal panel field of said hybrid roof cover system; and (b) a planar portion extending from said first lateral edge to a second lateral edge of said metal transition panel; and (c) a polymer layer bonded to an upper face of said planar portion of said metal transition panel, said polymer layer being adapted to bond to said membrane sheet in said membrane field of said hybrid roof cover system.

2. The metal transition panel of claim 1, wherein said polymer layer is bonded to substantially all of the upper face of said planar portion of said metal transition panel.

3. The metal transition panel of claim 1, wherein said polymer layer is bonded to substantially all of an upper face of said metal transition panel.

4. The metal transition panel of claim 1, wherein said polymer layer of said metal transition panel is composed of a thermoplastic polymer.

5. The metal transition panel of claim 4, wherein said thermoplastic polymer is selected from the group consisting of polyvinyl chloride, thermoplastic polyolefin, and ketone ethylene ester.

6. The metal transition panel of claim 1, wherein said polymer layer of said metal transition panel is composed of a thermoset polymer.

7. The metal transition panel of claim 6, wherein said thermoset polymer is ethylene propylene diene monomer.

8. The metal transition panel of claim 1, wherein said polymer layer is bonded to said planar portion of said metal transition panel by heat bonding.

9. The metal transition panel of claim 1, wherein said polymer layer is from about 25 to about 35 mm thick.

10. The metal transition panel of claim 1, wherein said first lateral edge of said metal transition panel comprises:

(a) an angled portion extending upward and outward from said planar portion;

(b) a vertical portion extending upward from said angled portion and generally perpendicular to said planar portion;

(c) a first horizontal portion extending inward from said vertical portion and generally parallel to said planar portion; and (d) a second horizontal portion extending above, outward from, and generally parallel to said first horizontal portion; and (e) wherein said lateral edge:

i) is formed by bends in said metal transition panel defining said portions of said lateral edge; and ii) said sidelap between said metal transition panel and said adjacent metal standing seam roof panel in said metal panel field is formed on panel clips of said metal panel field of said hybrid roof cover system.

11. The metal transition panel of claim 10, wherein said lateral edge angled portion extends from said planar portion at an angle of from about 30° to about 60°.

12. The metal transition panel of claim 10, wherein said lateral edge angled portion extends from said trough at an angle of about 45°.

13. The metal transition panel of claim 10, wherein said first and second lateral edge horizontal portions are doubled over to form a U-shaped channel adapted to receive a support portion of said panel clips of said metal panel field of said hybrid roof cover system.

14. A method of installing a hybrid roof cover system to accommodate projections through a roof, said method comprising:

(a) providing a metal panel field in a portion of said roof where said projections are not present, said metal panel field being provided by installing a plurality of metal standing seam roof panels by forming, on an array of panel clips, sidelaps along lateral edges of said metal standing seam roof panels;

(b) installing the metal transition panel of claim 1 to said adjacent metal standing seam roof panel in said metal panel field by forming, on said panel clips, a transition panel sidelap between said metal transition panel and said metal standing seam roof panel;

(c) providing a membrane field in a portion of said roof with said projections by bonding a membrane to said polymer layer of said metal transition panel; and (d) sealing said membrane around said projections.

15. A hybrid roof cover system, said hybrid roof cover system comprising:

(a) a metal panel field, said metal panel field comprising:

i) a plurality of panel clips attached to a support and arranged in linear arrays running along a pitch of said hybrid roof cover system; and ii) a metal panel cover attached to said panel clips, said metal panel cover comprising:

(1) a plurality of metal standing seam roof panels having upstanding symmetrical sides defining lateral edges;

(2) wherein said metal standing seam roof panels are interconnected along adjacent said lateral edges by sidelaps formed on said panel clips and extending along the pitch of said cover system; and (3) a trough extending between said lateral edges;

(b) a membrane field comprising a membrane sheet;

(c) a projection extending through said membrane field; and (d) a metal transition panel providing a transition from said metal panel field to said membrane field, said metal transition panel being a metal standing seam transition roof panel and comprising:

i) an upstanding side defining a first lateral edge of said metal transition panel that is symmetrical to said sides of said metal standing seam roof panels in said metal panel field;

ii) a planar portion extending horizontally from said first lateral edge to a second lateral edge of said metal transition panel; and iii) a polymer layer bonded to an upper face of said planar portion of said metal transition panel; and (e) wherein said first lateral edge of said metal transition panel is interconnected along a said lateral edge of a said metal standing seam roof panel in said metal panel field that is adjacent to said metal transition panel by a transition panel sidelap formed on said panel clips; and (f) said membrane sheet of said membrane field is bonded to said polymer layer of said metal transition panel.

16. The hybrid roof cover system of claim 15, wherein said polymer layer is bonded to substantially all of said upper face of said planar portion of said metal transition panel.

17. The hybrid roof cover system of claim 15, wherein said polymer layer is bonded to substantially all of an upper face of said metal transition panel.

18. The hybrid roof cover system of claim 15, wherein:

(a) said hybrid roof cover system comprises a first said metal panel field and a second said metal panel field and a first said metal transition panel and a second said metal transition panel;

(b) said membrane field extends between said first and second said metal panel fields; and (c) said first metal transition panel provides a transition from said first metal panel field to said membrane field and said second metal transition panel provides a transition from said second metal panel field to said membrane field.

19. The hybrid roof cover system of claim 15, wherein said hybrid roof cover system comprises an array of spaced purlins providing said support, said purlins running across the pitch of said hybrid roof cover system and said plurality of panel clips being attached to said purlins.

20. The hybrid roof cover system of claim 15, wherein:

(a) said hybrid roof cover system comprises a support board attached to said purlins and extending under said planar portion of said metal transition panel and across said membrane field; and (b) said membrane sheet of said membrane field is installed over said planar portion of said metal transition panel and said support board.

21. The hybrid roof cover system of claim 15, wherein said polymer layer of said metal transition panel is composed of a thermoplastic polymer.

22. The hybrid roof cover system of claim 21, wherein said thermoplastic polymer is selected from the group consisting of polyvinyl chloride, thermoplastic polyolefin, and ketone ethylene ester.

23. The hybrid roof cover system of claim 15, wherein said polymer layer of said metal transition panel is composed of a thermoset polymer.

24. The hybrid roof cover system of claim 23, wherein said thermoset polymer is ethylene propylene diene monomer.

25. The hybrid roof cover system of claim 15, wherein said polymer layer is bonded to said planar portion of said metal transition panel by heat bonding.

26. The hybrid roof cover system of claim 15, wherein said polymer layer is from about 25 to about 35 mm thick.

27. The hybrid roof cover system of claim 15, wherein said membrane sheet in said membrane field is composed of a thermoplastic polymer.

28. The hybrid roof cover system of claim 27, wherein said thermoplastic polymer is selected from the group consisting of polyvinyl chloride, thermoplastic polyolefin, and ketone ethylene ester.

29. The hybrid roof cover system of claim 15, wherein said membrane sheet in said membrane field is composed of a thermoset polymer.

30. The hybrid roof cover system of claim 29, wherein said thermoset polymer is ethylene propylene diene monomer.

31. The hybrid roof cover system of claim 15, wherein said membrane sheet is from about to about 60 mm thick.

32. The hybrid roof cover system of claim 15, wherein said hybrid roof cover system comprises insulation disposed between said support and said metal panel cover.

33. A hybrid roof recover system installed over an existing cover of a roof cover system, said hybrid recover system comprising:

(a) a metal panel recover field, said metal panel recover field comprising:

i) a plurality of panel clips mounted above said existing cover system and arranged in linear arrays running along a pitch of said hybrid roof recover system;

ii) a metal panel recover attached to said panel clips, said metal panel recover comprising:

(1) a plurality of metal standing seam roof panels having upstanding symmetrical sides defining lateral edges;

(2) wherein said metal standing seam roof panels are interconnected along adjacent said lateral edges by sidelaps formed on said panel clips and extending along the pitch of said cover system; and (3) a trough extending between said lateral edges;

(b) a membrane recover field comprising a membrane sheet;

(c) a projection extending through said membrane field; and (d) a metal transition panel providing a transition from said metal panel recover field to said membrane recover field, said metal transition panel being a metal standing seam transition roof panel and comprising:

i) an upstanding side defining a first lateral edge of said metal transition panel that is symmetrical to said sides of said metal standing seam roof panels in said metal panel recover field;

ii) a planar portion extending horizontally from said first lateral edge to a second lateral edge of said metal transition panel; and iii) a polymer layer bonded to an upper face of said planar portion of said metal transition panel; and (e) wherein said first lateral edge of said metal transition panel is interconnected along a said lateral edge of a said metal standing seam roof panel in said metal panel recover field that is adjacent to said metal transition panel by a transition panel sidelap formed on said panel clips; and (f) said membrane sheet of said membrane recover field is bonded to said polymer layer of said metal transition panel.

34. The hybrid roof recover system of claim 33, wherein said polymer layer is bonded to substantially all of said upper face of said planar portion of said metal transition panel.

35. The hybrid roof recover system of claim 33, wherein said polymer layer is bonded to substantially all of an upper face of said metal transition panel.

36. The hybrid roof recover system of claim 33, wherein said panel clips are attached to said existing cover system.

* * * * *